US005520342A

United States Patent [19]

Hendrickson et al.

[11] Patent Number: 5,520,342

[45] **Date of Patent: * May 28, 1996**

[54] APPARATUS FOR RECYCLING ASPHALT MATERIALS

[76] Inventors: Arthur N. Hendrickson, 777 Hilltop Ct., Coram, N.Y. 11727; Lawrence C. Hanlon, 33 Haskell Ave., South Portland, Me. 04106; Russell W. Anderson, 183 Youngs Rd., Mahwah, N.J. 07430

[ * ] Notice: The portion of the term of this patent subsequent to Feb. 23, 2010, has been disclaimed.

[21] Appl. No.: 200,244

[22] Filed: Feb. 23, 1994

Related U.S. Application Data

[63] Continuation-in-part of Ser. No. 19,117, Feb. 17, 1993, Pat. No. 5,294,062.

[51] Int. Cl.[6] ..... B02C 13/02

[52] U.S. Cl. ..... 241/67; 241/167; 241/299

[58] Field of Search ..... 241/57, 65, 67, 241/74, 167, 299

[56] References Cited

U.S. PATENT DOCUMENTS

| | | | |
|---|---|---|---|
| Re. 31,904 | 6/1985 | Mendenhall . | |
| 527,636 | 10/1894 | Walker | 241/65 |
| 770,823 | 9/1904 | Salzmann | 241/65 |
| 1,594,046 | 7/1926 | Carr . | |
| 2,084,713 | 6/1937 | Thayer . | |
| 3,868,817 | 3/1975 | Marion et al. . | |
| 3,871,291 | 3/1975 | Lassiter | 100/93 P |
| 3,975,002 | 8/1976 | Mendenhall | 259/148 |
| 4,028,527 | 6/1977 | Thagard, Jr. . | |
| 4,075,710 | 2/1978 | Jakob et al. . | |
| 4,106,110 | 8/1978 | Mendenhall | 366/2 |
| 4,147,436 | 4/1979 | Garbelman et al. . | |
| 4,207,062 | 6/1980 | Moench et al. . | |
| 4,264,826 | 4/1981 | Ullmann . | |
| 4,332,478 | 6/1982 | Binz . | |
| 4,347,016 | 8/1982 | Sindelar et al. . | |
| 4,354,826 | 10/1982 | Kruger et al. . | |
| 4,369,926 | 1/1983 | Rasmussen et al. | 241/18 |
| 4,373,675 | 2/1983 | Kaufman | 241/23 |
| 4,422,846 | 12/1983 | Weber et al. . | |
| 4,427,376 | 1/1984 | Etnyre et al. . | |
| 4,429,645 | 2/1984 | Burton . | |
| 4,477,984 | 10/1984 | Wenger . | |
| 4,504,149 | 3/1985 | Mendehall . | |
| 4,555,182 | 11/1985 | Mendenhall | 366/25 |

(List continued on next page.)

FOREIGN PATENT DOCUMENTS

| | | | |
|---|---|---|---|
| 0698649 | 11/1979 | U.S.S.R. | 241/74 |

*Primary Examiner*—John Husar
*Attorney, Agent, or Firm*—Samuelson & Jacob

[57] ABSTRACT

Apparatus for processing recyclable asphalt material includes an elongate drum having a generally cylindrical wall, a central axis, a first end and a second end, and being mounted for rotation about the central axis, with the central axis tilted at an acute angle so as to elevate one of the first and second ends relative to the other of the first and second ends, a heating chamber adjacent the first end of the drum, a plurality of breaker members arrayed generally parallel to the central axis of the drum and placed within the drum, a heat conduit extending along the drum coaxial with the breaker members, a heating arrangement for supplying heat to the heating chamber, ducting interconnecting the heating chamber, the breaker members, and the heat conduit serially such that heat from the heating chamber is conducted from adjacent the first end of the drum to adjacent the second end of the drum and is returned to adjacent the first end of the drum serially through the breaker members and the heat conduit, a feed arrangement for feeding the recyclable asphalt material into the drum, adjacent the elevated one of the first and second ends of the drum, and a rotational drive for rotating the drum, the breaker members and the heat conduit about the central axis so as to tumble the recyclable asphalt material within the drum, against the breaker members and against the heat conduit to process and deliver the desired recycled asphalt material adjacent the other of the first and second ends of the drum.

12 Claims, 14 Drawing Sheets

U.S. PATENT DOCUMENTS 4,583,468 4/1986 Reed et al. .
4,612,711 9/1986 Murray .
4,676,740 6/1987 de Beus .
4,692,028 9/1987 Schave .
4,705,404 11/1987 Bruggemann .
4,787,938 11/1988 Hawkins .
4,813,784 3/1989 Musil .
4,844,020 7/1989 Bruhn .
4,892,411 1/1990 Elliot et al. .
4,932,863 6/1990 Anderson ..... 432/115
4,988,289 1/1991 Coucher .
4,989,986 2/1991 Swisher, Jr. .
5,188,299 2/1993 Hendrickson et al. ..... 241/23
5,294,062 3/1994 Hendrickson et al. ..... 241/67

APPARATUS FOR RECYCLING ASPHALT MATERIALS

This is a continuation-in-part of patent application Ser. No. 08/019,117, filed Feb. 17, 1993, now U.S. Pat. No. 5,294,062.

The present invention relates generally to the processing of asphalt materials and pertains, more specifically, to recycling existing asphalt pavement materials.

Asphalt has long been the material of choice for pavement and has found widespread use throughout the world in filling the need for more and more pavement. More recently, recycled asphalt products are being specified for use in an effort to conserve materials used in asphalt production. The use of recycled asphalt materials has become more important as existing pavement is reconditioned or replaced and the disposal of the old, replaced pavement material becomes more difficult and more costly. As a result, large amounts of old asphalt material have become available for reuse; however, current practices have limited such reuse to crushing the relatively large pieces of old asphalt materials, as received from the field, and then mixing the crushed, reduced-size recyclable asphalt material with new material. The mixing of recyclable asphalt material with virgin asphalt has led to unstable reactions, produces unwanted amounts of pollutants, and thus severely limits the use of recyclable asphalt materials.

Five basic methods currently are in use for the utilization of recyclable asphalt. In the weigh-hopper method, uncoated virgin aggregate is superheated and then added to recyclable asphalt material in a hopper where heat is transferred quite rapidly from the heated aggregate to the recyclable asphalt material. The result is a tendency toward an unstable reaction at the point of blending, limiting the amount of recyclable asphalt material which can be introduced. In the batch plant bucket elevator method, recyclable asphalt material is metered into a bucket elevator where heat transfer takes place. Again, the percentage of recyclable asphalt material must be limited in order to preclude the emission of excessive pollutants. Another method uses a parallel-flow drum mixer in which virgin aggregates are introduced at the burner end of a drum and are superheated. Recyclable asphalt material is introduced downstream, adjacent the center of the drum, where the recyclable asphalt material is mixed with the superheated virgin aggregate and hot gases. The exposure of fine recyclable asphalt material to the superheated aggregate and hot gases causes a rapid flash-off and the emission of "blue-smoke", a highly undesirable pollutant, in addition to other hydrocarbon emissions. These emissions must be controlled, resulting in strict limitations on the amounts of recyclable asphalt products introduced by the method. In a similar procedure, a separate mixing chamber is used in connection with a parallel-flow drum mixer so that the recyclable asphalt materials are mixed with heated aggregate outside the hot gas stream in the drum. The method enables the introduction of greater amounts of recyclable asphalt materials without the creation of blue-smoke, but hydrocarbon emissions must still be contended with. The use of a counter-flow drum mixer with a separate mixing chamber, wherein the location of the burner is reversed so that virgin material moves toward the burner while exhaust gases move in the opposite direction, constitutes another improvement in that even more recyclable asphalt material can be mixed with virgin material; however, the amount of recyclable asphalt material must still be limited in order to control the emission of pollutants. All of the above-outlined methods usually require a separate scrubber and screening apparatus for sizing the recyclable asphalt material prior to introducing the material into the mix with virgin aggregate.

The present invention provides apparatus which avoids many of the problems encountered in the above-outlined apparatus and methods and exhibits several objects and advantages, some of which may be summarized as follows: Eliminates the need for preliminary crushing and screening of recyclable asphalt materials received from the field, and the equipment needed for such preliminary crushing and screening; precludes direct contact between the recyclable asphalt materials and any open flame or hot gases, thereby eliminating a potential source of pollutants, and especially "blue-smoke" and hydrocarbon emissions; effectively recycles used asphalt materials for use either in a mix containing a very high percentage of recycled product with virgin aggregate and asphalt, or one-hundred percent recycled materials; provides apparatus which is relatively compact and even more portable than before for ready transportation and use directly at a wider variety of project sites; enables increased versatility in complementing existing asphalt plants for the use of recycled asphalt product; provides an environmentally sound approach to the conservation of asphalt products at minimal cost; eliminates the need for disposal of used asphalt materials; effectively deals with pollutants which emanate from the asphalt materials being processed for reuse; enables the practical processing of recyclable asphalt materials for widespread use with efficiency and reliability.

The above objects and advantages, as well as further objects and advantages, are attained by the present invention which may be described briefly as apparatus for processing recyclable asphalt material received from the field in relatively large pieces for delivery in a mass containing desired smaller aggregate-sized pieces for reuse, the apparatus comprising: an elongate drum having a generally cylindrical wall, a central axis, a first end and a second end, the cylindrical wall including an inner surface and an outer surface; mounting means for mounting the drum for rotation about the central axis, with the central axis tilted at an acute angle so as to elevate one of the first and second ends relative to the other of the first and second ends; a heating chamber adjacent the first end of the drum, the heating chamber having an interior; a plurality of breaker members, the breaker members being tubular and extending along the drum between the first and second ends of the drum, the breaker members being arrayed generally parallel to the central axis of the drum and placed between the central axis and the wall of the drum; a heat conduit extending along the drum between the first and second ends of the drum, the heat conduit being coaxial with the breaker members; heating means for supplying heat to the interior of the heating chamber; ducting means interconnecting the interior of the heating chamber, the breaker members, and the heat conduit serially such that heat from the interior of the heating chamber is conducted from adjacent the first end of the drum to adjacent the second end of the drum and is returned to adjacent the firs end of the drum serially through the breaker members and the heat conduit; feed means for feeding the large pieces of recyclable asphalt material received from the field into the drum, adjacent the elevated one of the first and second ends of the drum; and rotational means for rotating the drum, the breaker members and the heat conduit about the central axis so as to tumble the large pieces of recyclable asphalt material within the drum, against the breaker members and against the heat conduit, thereby simultaneously reducing the size of the relatively large pieces to the desired aggregate-sized pieces and heating the mass containing the desired aggregate-sized pieces, which mass proceeds toward the other of the first and second ends of the drum for delivery from the drum.

The invention will be understood more fully, while still further objects and advantages will become apparent in the following detailed description of preferred embodiments of the invention illustrated in the accompanying drawing, in which.

Figure 1:
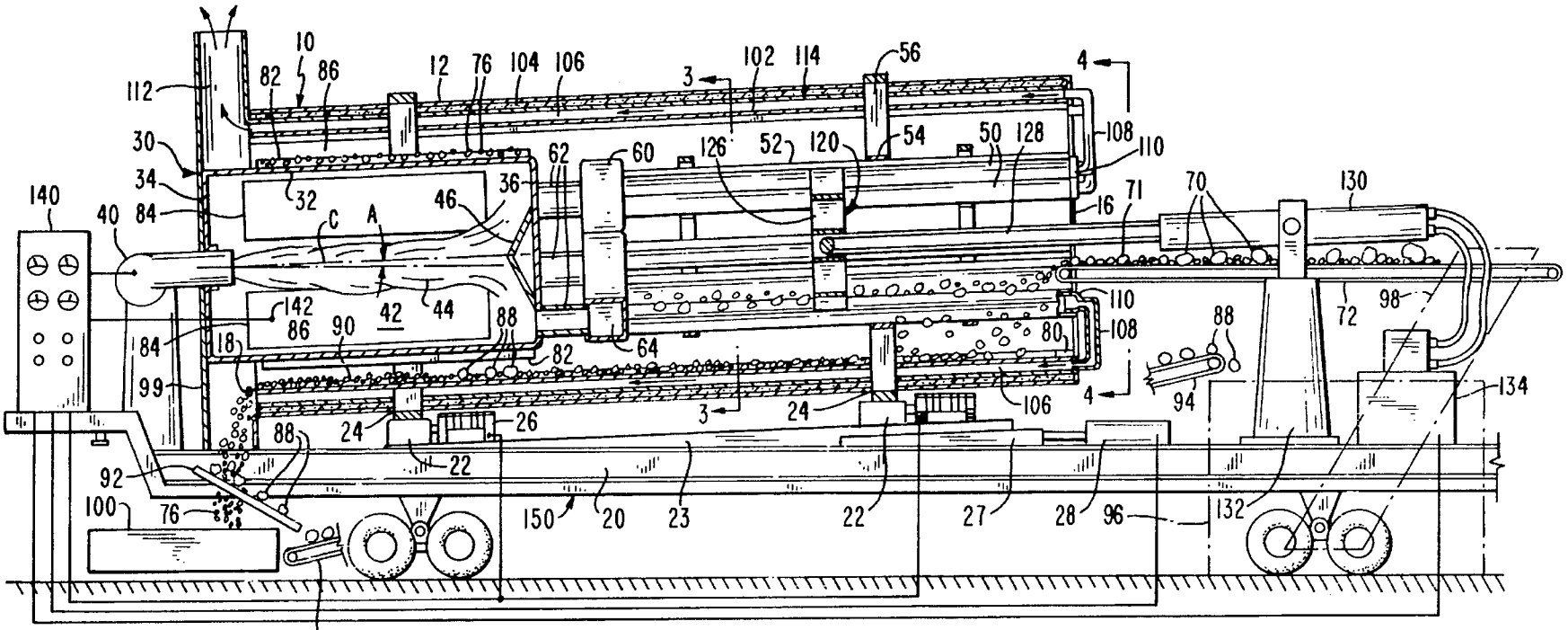
FIG. 1 is a somewhat diagrammatic, longitudinal cross-sectional view of an apparatus constructed in accordance with the present invention, illustrating one embodiment of the invention.
Figure 2:
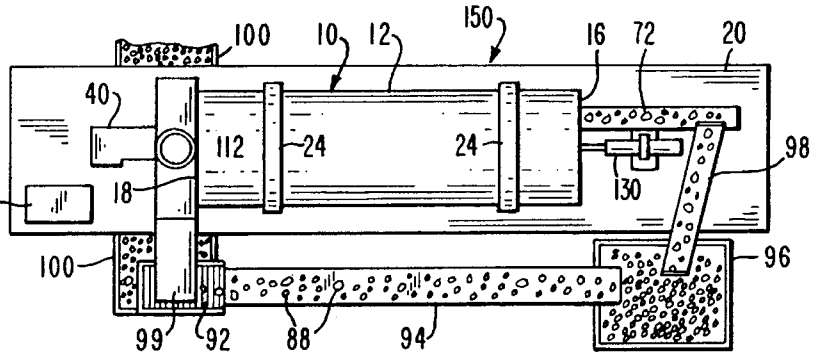
FIG. 2 is a plan view, reduced in size, of the apparatus of FIG. 1.

Referring now to the drawing, and especially to FIGS. 1 and 2 thereof, an apparatus constructed in accordance with the present invention is illustrated generally at 10 and is seen to include an elongate drum 12 having a generally cylindrical wall 14 extending axially between an inlet end 16 and an outlet end 18. Drum 12 is mounted upon a platform 20 for rotation about a central axis C by means of roller assemblies 22 placed on a base 23 on the platform 20 and engaging corresponding circumferential tracks 24 carried by the drum 12, and motors 26 drive the roller assemblies 22, all in a manner now well known in asphalt processing apparatus. Alternately, a separate chain-and-sprocket drive may couple the motors 26 with the drum 12. The base 23 is inclined so that the inlet end 16 of the drum 12 is elevated relative to the outlet end 18. The angle of inclination A is maintained relatively shallow, an angle A of only about four degrees being sufficient for the purposes to be described below. Angle A is selectively adjusted by adjustment means shown in the form of a wedge 27 moved forward or backward by an actuator 28 to increase or decrease the magnitude of angle A.

Figure 3:
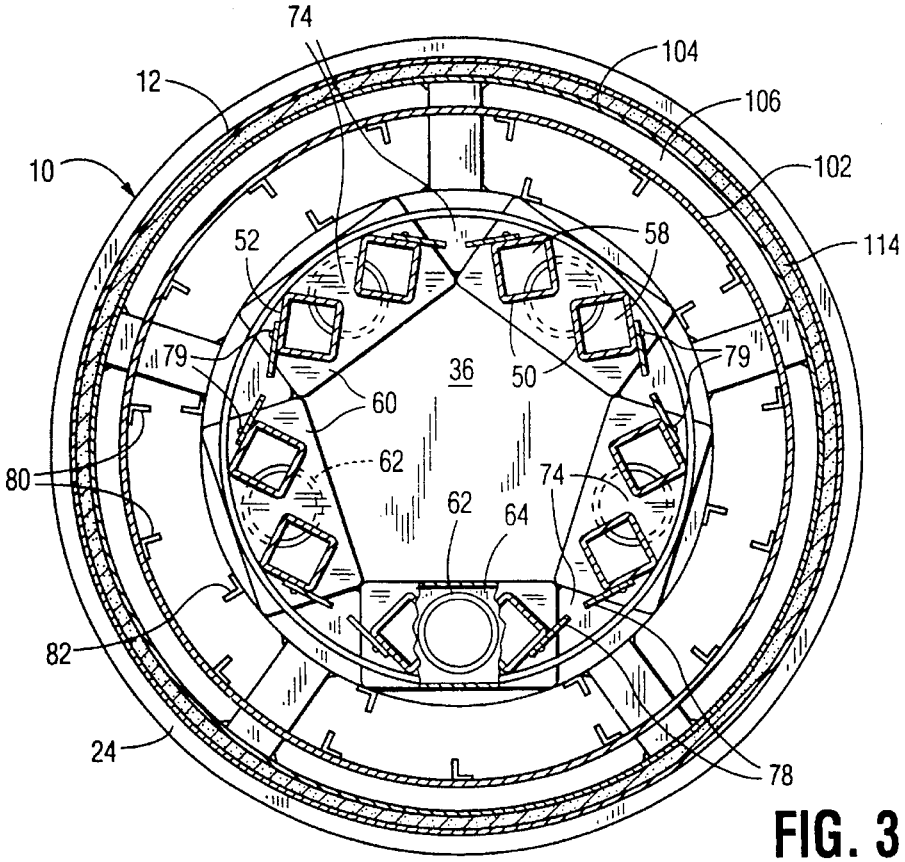
FIG. 3 is an enlarged cross-sectional view taken along line 3—3 of FIG. 1.
Figure 4:
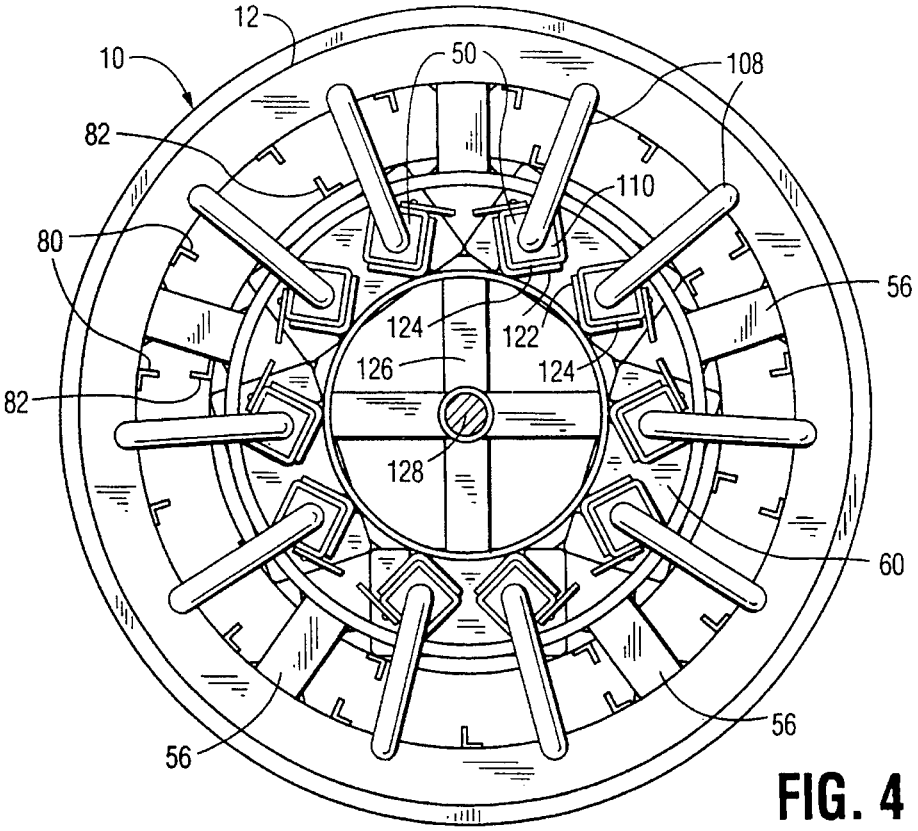
FIG. 4 is an enlarged cross-sectional view taken along line 4—4 of FIG. 1.

A heating chamber 30 is located adjacent the outlet end 18 of the drum 12 and includes a cylindrical side wall 32 which extends along the drum 12 toward the inlet end 16 over a first axial portion of drum 12 from a rear wall 34 to a front wall 36. Heating means in the form of a burner 40 is mounted on the platform 20 outside the heating chamber 30 and projects into the interior 42 of the heating chamber 30 through the rear wall 34 to provide a heating flame 44 within the interior 42 of the heating chamber 30. Heating flame 44 impinges upon a baffle 46 at the front wall 36. A plurality of breaker members in the form of tubular members 50 extend axially, along a second axial portion of drum 12, between the heating chamber 30 and the inlet end 16 of the drum 12, generally parallel to the central axis C, and are arrayed circumferentially about the central axis C. The tubular members 50 are assembled into a cage-like assembly 52 which is supported within the drum 12 by a support ring 54 and struts 56. As illustrated in FIGS. 3 and 4, each tubular member 50 has an interior 58 which extends axially along the length of the tubular member 50. Headers in the form of manifolds 60 are integral with the ends of the tubular members 50 adjacent the heating chamber 30, and the manifolds 60 are integral with the front wall 36 of the heating chamber 30 to connect the tubular members 50 with the heating chamber 30. As best seen in FIG. 3, as well as in FIG. 1, two tubular members 50 are connected to each manifold 60 and each manifold 60 has a single leg 62 connected to the front wall 36 of the heating chamber 30. The interior 58 of each tubular member 50 communicates with the interior 42 of the heating chamber 30 through the interior 64 of each corresponding manifold 60 so that hot gases generated in the heating chamber 30 pass through the manifolds 60 and into the tubular members 50.

Recyclable asphalt material is received from the field in relatively large pieces 70, usually in chunks spanning about one foot across, and is fed directly into apparatus 10, as seen at 71. The large pieces 70 are fed by an infeed conveyor 72 through the inlet end 16 of the drum 12 and into the cage-like assembly 52 established by the array of tubular members 50. As the drum 12 is rotated, the cage-like assembly 52 also rotates about the central axis C and the large pieces 70 are tumbled within the cage-like assembly 52 and simultaneously are broken up and heated by contact with the tubular members 50 of the cage-like assembly 52 as the recyclable asphalt material proceeds downstream from the inlet end 16 toward the outlet end 18 of the drum 12. The circumferential spacing 74 between adjacent tubular members 50 is selected so that upon reaching the desired aggregate-size, the recyclable asphalt material 76 will drop out of the cage-like assembly 52, and fall to wall 14 of the drum 12. A preferred circumferential spacing 74 is a gap of about two to four inches between adjacent tubular members 50, which circumferential spacing yields a desired size of about three-quarters of an inch in the recycled asphalt material which leaves the drum 12 at the outlet end 18. Auxiliary bars 78 are affixed to some of the tubular members 50 and extend circumferentially to assure that the prescribed spacing 74 is maintained between all adjacent tubular members 50. The spacing 74 between adjacent auxiliary bars 78 is adjustable by means of selectively loosened fasteners 79 which secure the auxiliary bars 78 to the tubular members 50. The desired aggregate-sized recyclable asphalt material 76 continues down the wall 14 of the drum 12, assisted by flights 80 affixed to the wall 14, until the material 76 reaches the outlet end 18 of the drum 12. In addition, material 76 is tumbled onto the side wall 32 of the heating chamber 30 where additional heat is transferred to the material 76 and further flights 82 affixed to side wall 32 assist in moving the material 76 downstream. The side wall 32 of the heating chamber 30 is provided with access panels 84 which enable selective access to the interior portion 86 of the drum 12 around the heating chamber 30 from the interior 42 of the heating chamber 30, so that in the event of a sudden shut-down due to a power failure or the like and a consequent cessation of rotation of the drum 12, the mass of material 76 in the interior portion 86 can be removed while still essentially molten.

The legs 62 of the manifolds 60 are spaced apart circumferentially a distance greater than the spacing 74 between the tubular members 50. Thus, intermediate-sized pieces 88 of recyclable asphalt material which now are smaller than pieces 70, but still remain larger than that which is permitted to fall through spacing 74, will fall between the legs 62 to enter the mass of material in the stream 90 of asphalt material leaving the drum 12. After leaving the drum 12, the stream 90 is passed through a screen 92 where the intermediate-sized pieces 88 are separated and transferred to a back feed conveyor 94. Back feed conveyor 94 delivers the intermediate-sized pieces 88 to a bin 96, and an elevator 98 moves the intermediate-sized pieces 88 from the bin 96 to the infeed conveyor 72 for return to the drum 12. The stream 90 of desired aggregate-sized pieces of material 76 is delivered through an exit chute 99 to an outfeed conveyor 100 for use. It is noted that at no time is the recyclable asphalt material exposed to direct flame. Moreover, introduction of the recyclable asphalt material at the inlet end 161, remote from the heating chamber 30, presents the recyclable asphalt material at the lower temperature end of the drum 12, and the temperature is raised gradually as the material progresses toward the outlet end 18, thereby reducing any tendency toward generating excessive harmful pollutants.

In the preferred configuration, wall 14 of drum 12 is comprised of an inner wall 102 and an outer wall 104, with an annular heat chamber 106 between the inner wall 102 and the outer wall 104. Return members in the form of elbows 108 are connected between the end 110 of each tubular member 50 and the annular heat chamber 106 so that the heated gases which pass from the heating chamber 30 through the tubular members 50 is directed into the annular heat chamber 106 to flow through the wall 14 of the drum 12 and further heat the wall 14 as the heated gases are passed to an exhaust port 112 at the downstream, outlet end 18 of the drum 12. In this manner heat is conserved and more heat is made available for the process. An insulating jacket 114 extends circumferentially around the drum 12 to further conserve heat, as explained in U.S. Pat. No. 4,932,863.

In order to preclude the deleterious build up of excessive asphalt on the tubular members 50, a scraper assembly 120 is mounted for reciprocating movement along the cage-like assembly 52. Referring to FIG. 4, as well as to FIG. 1, scrapers 122 are engaged with the outer surfaces 124 of the tubular members 50 and are affixed to a spider 126 which is carried by a spindle 128. Spindle 128 is reciprocated in upstream and downstream directions periodically by selective actuation of a hydraulic cylinder 130 mounted on a pedestal 132 on platform 20 and actuated under the control of control box 134. Upon actuation of the hydraulic cylinder 130, scrapers 132 will ride upon and move along the outer surfaces 124 of the tubular members 50 to scrape away excessive asphalt and maintain the surfaces 124 free to transfer heat to the pieces 70 of recyclable asphalt being tumbled in the cage-like assembly 52. Tubular members 50 preferably are provided with a rectangular cross-sectional configuration, as shown in FIGS. 3 and 4.

A central control console 140 controls various parameters in the operation of the apparatus 10. Thus, the control console 140 is operated to control the speed of rotation of the motors 26 to select the speed of rotation of drum 12. A temperature sensor 142 in the heating chamber 30 is connected to the control console 140 which, in turn, controls the burner 40 to maintain the temperature within the interior 42 of the heating chamber 30 at a selected level. Further, the selected pitch of the drum 12 is controlled by the control console 140 through operation of the actuator 28. In addition, the control console 140 controls the operation of the scraper assembly 120. Typically, angle A is set at about three to six degrees, the temperature in the interior of the heating chamber 30 is within the range of about fifteen-hundred to two-thousand degrees F., and the speed of rotation of the drum 12 is within the range of about five to seven revolutions per minute. The temperature of the recycled asphalt material exiting at the outlet end 18 of the drum 12 is about two-hundred to two-hundred-fifty degrees F.

Platform 20 is a part of a truck trailer 150 so that the apparatus 10 is portable and is made available readily at a work site. The apparatus 10 is compact and requires very little by way of facilities in order to operate in the field.

Figure 5:
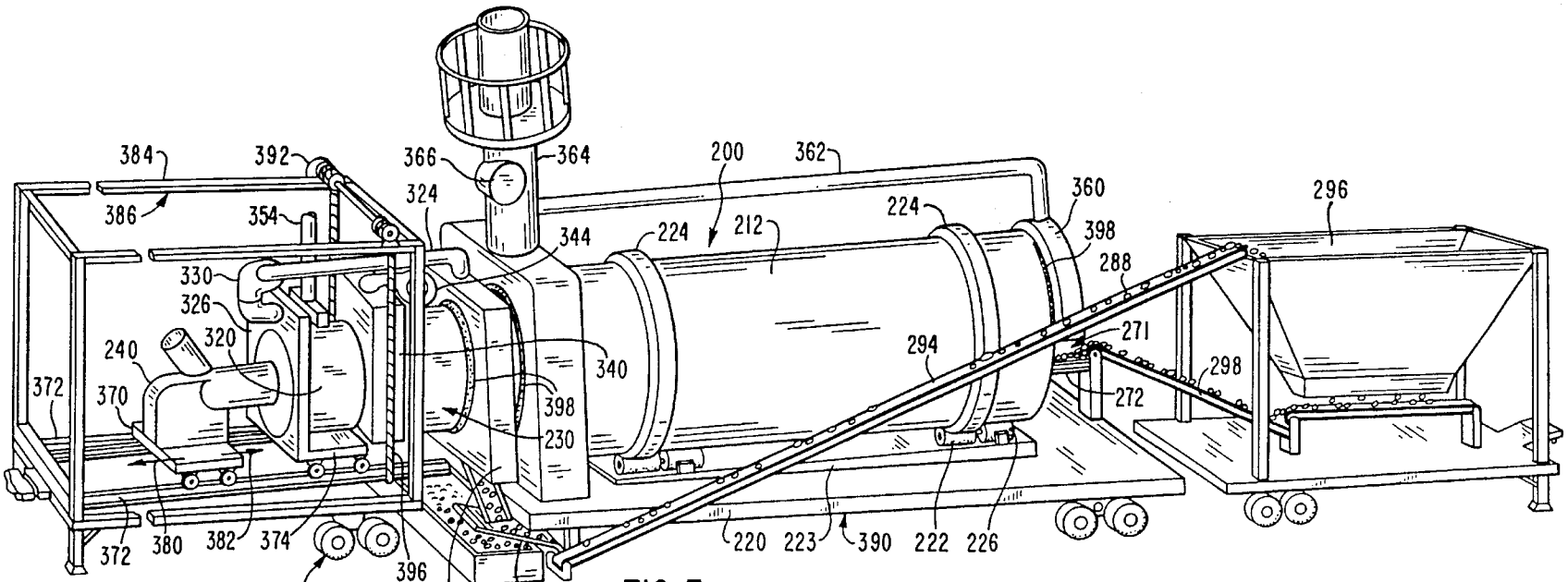
FIG. 5 is pictorial view showing another embodiment of the invention.
Figure 6:
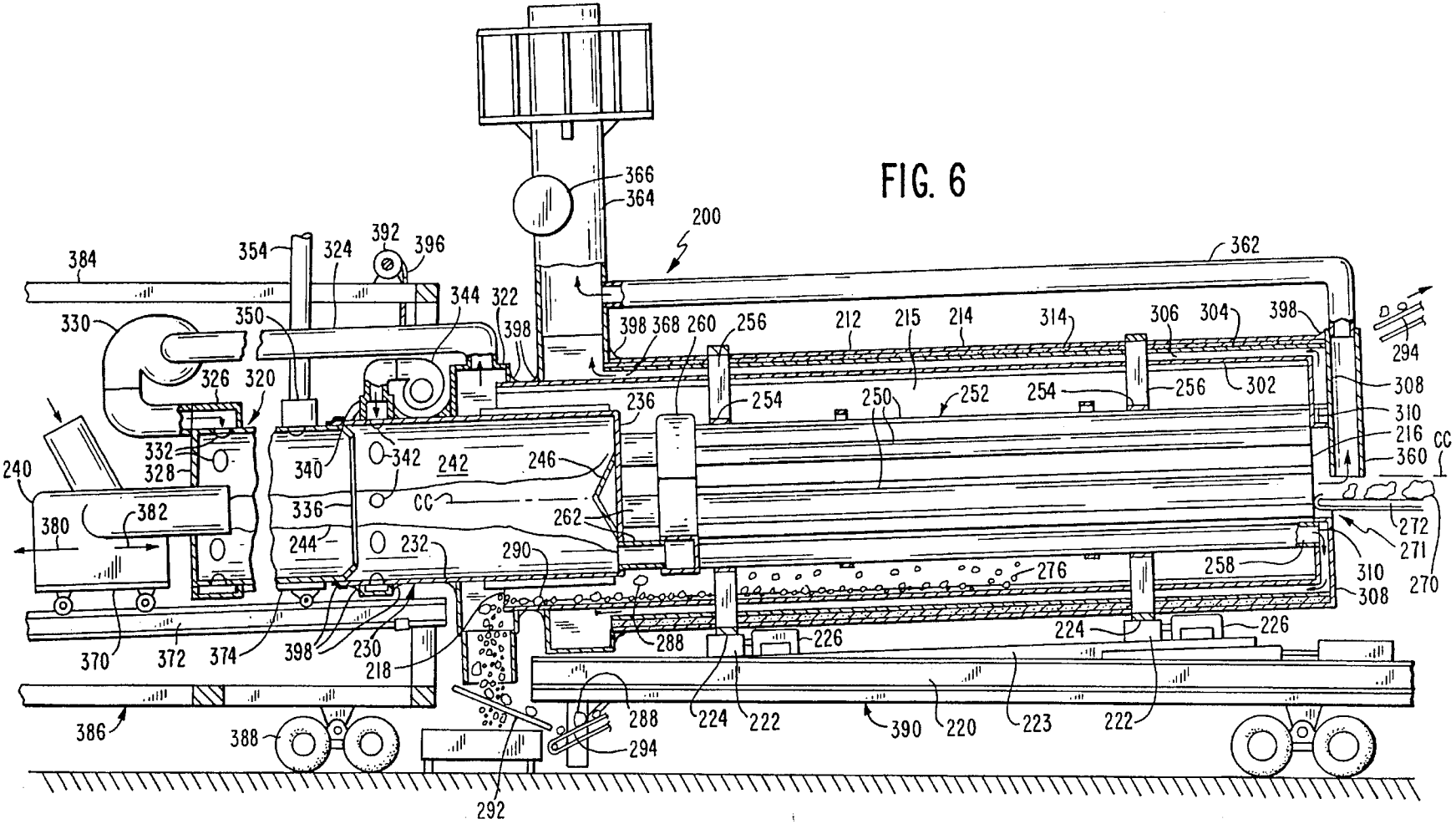
FIG. 6 is a somewhat diagrammatic, longitudinal cross-sectional view of the apparatus of FIG. 5.

Turning now to FIGS. 5 and 6, another embodiment of the invention is illustrated in the form of apparatus 200 which is seen to include an elongate drum 212 having a generally cylindrical wall 214 and an interior 215 extending axially between an inlet end 216 and an outlet end 218. Drum 212 is mounted upon a platform 220 for rotation about a central axis CC by means of roller assemblies 222 placed on a base 223 on the platform 220 and engaging corresponding circumferential tracks 224 carried by the drum 212, and electric motors 226 drive the roller assemblies 222, all in a manner similar to that described above in connection with apparatus 10. Alternately, a separate chain-and-sprocket drive may couple the electric motors 226 with the drum 212. The base 223 is inclined so that the inlet end 216 of the drum 212 is elevated relative to the outlet end 218. The angle of inclination is maintained relatively shallow and is adjustable, all as described above in connection with apparatus 10.

A heating chamber 230 is located adjacent the outlet end 218 of the interior 215 of the drum 212 and includes a cylindrical side wall 232 which extends along the drum 212 toward the inlet end 216 over a first axial portion of drum 212 from an inlet end 234 of the heating chamber 230 to a front wall 236. A burner 240 is located outside the heating chamber 230 and projects toward the interior 242 of the heating chamber 230 to provide a heating flame 244 projecting toward the interior 242 of the heating chamber 230. A baffle 246 is provided at the front wall 236. A plurality of breaker members in the form of tubular members 250 extend axially, along a second axial portion of drum 212, between the heating chamber 230 and the inlet end 216 of the interior 215 of the drum 212, generally parallel to the central axis CC, and are arrayed circumferentially about the central axis CC. The tubular members 250 are assembled into a cage-like assembly 252 which is supported within the drum 212 by support rings 254 and struts 256. As described in connection with tubular members 50 above, each tubular member 250 has an interior 258 which extends axially along the length of the tubular member 250. Headers in the form of manifolds 260 are integral with the ends of the tubular members 250 adjacent the heating chamber 230, and the manifolds 260 are integral with the front wall 236 of the heating chamber 230 to connect the tubular members 250 with the heating chamber 230. As before, two tubular members 250 are connected to each manifold 260 and each manifold 260 has a single leg 262 connected to the front wall 236 of the heating chamber 230. The interior 258 of each tubular member 250 communicates with the interior 242 of the heating chamber 230 through the interior 264 of each corresponding manifold 260 so that hot gases in the heating chamber 230 pass through the manifolds 260 and into the tubular members 250.

Recyclable asphalt material is received from the field in relatively large pieces 270, usually in chunks spanning about one foot across and is fed directly into apparatus 200, as seen at 271. The large pieces 270 are fed by an infeed conveyor 272 through the inlet end 216 of the interior 215 of drum 212 and into the cage-like assembly 252 established by the array of tubular members 250. As the drum 212 is rotated, the cage-like assembly 252 also rotates about the central axis CC and the large pieces 270 are tumbled within the cage-like assembly 252 and simultaneously are broken up and heated by contact with the tubular members 250 of the cage-like assembly 252 as the recyclable asphalt material proceeds downstream from the inlet end 216 toward the outlet end 218 of the interior 215 of drum 212. The circumferential spacing between adjacent tubular members 250 is selected so that upon reaching the desired aggregate-size, the recyclable asphalt material 276 will drop out of the cage-like assembly 252, and fall to wall 214 of the drum 212, all as described above in connection with apparatus 10. The desired aggregate-sized recyclable asphalt material 276 continues down the wall 214 of the drum 212, assisted by flights 280 affixed to the wall 214, until the material 276 reaches the outlet end 218 of the interior 215 of the drum 212. In addition, material 276 is tumbled onto the side wall 232 of the heating chamber 230 where additional heat is transferred to the material 276 and further flights 282 affixed to side wall 232 assist in moving the material 276 downstream.

The legs 262 of the manifolds 260 are spaced apart circumferentially a distance greater than the spacing between the tubular members 250. Thus, intermediate-sized pieces 288 of recyclable asphalt material which now are smaller than pieces 270, but still remain larger than that which is permitted to fall through the spacing between the tubular members 250, will fall between the legs 262 to enter the mass of material in the stream 290 of asphalt material leaving the drum 212. After leaving the drum 212, the stream 290 is passed through a screen 292 where the intermediate-sized pieces 288 are separated and transferred to a back feed conveyor 294. Back feed conveyor 294 delivers the intermediate-sized pieces 288 to a bin 296, and an elevator 298 moves the intermediate-sized pieces 288 from the bin 296 to the infeed conveyor 272 for return to the drum 212. The stream 290 of desired aggregate-sized pieces of material 276 is delivered through an exit chute to an outfeed conveyor, as described before.

In the preferred configuration, wall 214 of drum 212 is comprised of an inner wall 302 and an outer wall 304, with an annular heat chamber 306 between the inner wall 302 and the outer wall 304. Return members in the form of elbows 308 are connected between the end 310 of each tubular member 250 and the annular heat chamber 306 so that the heated gases which pass from the heating chamber 230 through the tubular members 250 are directed into the annular heat chamber 306 to flow through the wall 214 of the drum 212 and further heat the wall 214 as the heated gases are passed downstream. In this manner heat is conserved and more heat is made available for the process. An insulating jacket 314 extends circumferentially around the drum 212 to further conserve heat, as explained in U.S. Pat. No. 4,932,863.

It is noted that at no time is the recyclable asphalt material exposed to direct flame. Moreover, introduction of the recyclable asphalt material at the inlet end 216, remote from the heating chamber 230, presents the recyclable asphalt material at the lower temperature end of the drum 212, and the temperature is raised gradually as the material progresses toward the outlet end 218, thereby reducing any tendency toward generating excessive harmful pollutants. However, any harmful pollutants which may be generated in the interior 215 of the drum 212 during the process is dealt with in apparatus 200, as described below.

Volatile pollutants which emanate from the recyclable asphalt material as the process is being carried out in the apparatus 200 are dealt with by oxidizing the pollutants in a volatile organic compound oxidation device 320. To that end, the volatile pollutants are conducted from the interior 215 of the drum 212 to the volatile organic compound oxidation device 320 by gas conduction means shown in the form of a manifold 322 located adjacent the outlet end 218 of the interior 215 of the drum 212 and a duct 324 extending between and communicating with the manifold 322 and a plenum chamber 326 extending around the outer periphery of the volatile organic compound oxidation device 320 at the inlet end 328 of the volatile organic compound oxidation device 320. A fan 330 draws the volatile pollutants from the interior 215 of the drum 212, through the manifold 322 and duct 324, and forces the volatile pollutants into the plenum chamber 326, to pass through openings 332 into the volatile organic compound oxidation device 320.

The volatile organic compound oxidation device 320 is a device of a type well known in the art of pollution control and operates in response to heat to oxidize the volatile pollutants delivered from the interior 215 of the drum 212. By interposing the device 320 between the burner 240 and the heating chamber 230, the burner 240 provides the heat necessary to operate the device 320, thus rendering the use of the device 320 economical and practical. Upon oxidation of the pollutants in the device 320, additional heat is produced by the oxidation reaction. Should the heat become too intense for safe introduction into the heating chamber 230, cooling means interposed between the volatile organic compound oxidation device 320 and the heating chamber 230 is employed to reduce the temperature between the outlet 336 of the volatile organic compound oxidation device 320 and the interior 242 of the heating chamber 230. Thus, air distribution means in the form of a plenum 340 is placed on the volatile organic compound oxidation device 320 so as to be located adjacent the inlet end 234 of the heating chamber 230 and communicate with the interior 242 of the heating chamber 230 through apertures 342. A blower 344 forces ambient air into the plenum 340 to be distributed into the volatile organic compound oxidation device 320 and to the interior 242 of the heating chamber 230 for reducing the temperature at the inlet end 234 of the heating chamber 230. Alternately, the plenum 340 may be placed on the heating chamber 230 itself, adjacent the inlet end 234 of the heating chamber 230 and the outlet 336 of the volatile organic compound oxidation device 320, rather than on the volatile organic compound oxidation device 320, for reducing the temperature at the inlet end 234 of the heating chamber 230. In either arrangement, the cooling means is interposed between the volatile organic compound oxidation device 320 and the heating chamber 230 for distributing ambient air to the interior of the heating chamber 230 to reduce the temperature at the inlet end 234 of the heating chamber 230.

When use of the apparatus 200 is to be discontinued, there is a gradual slow-down in production in the drum 212, requiring lowered heat to the tubular members 250; however, full heat must be maintained in the volatile organic compound oxidation device 320 for continued appropriate operation during the transition from full operation to full shut-down. Accordingly, heat is bypassed by the opening of a damper 350 located adjacent the outlet 336 of the volatile organic compound oxidation device 320, which damper 350 is opened to vent excess heat through a stack 354 in order to bypass heat from the volatile organic compound oxidation device 320 away from the heating chamber 230 and thereby protect the component parts of the apparatus 200 against excessively high temperatures during cool down. As a further measure of protection against the effects of excessive heat, it is preferable to construct the heating chamber 230, the manifolds 260 and at least the portions of the tubular members 250 located adjacent the manifolds 260 and the heating chamber 230, of a heat and corrosion resistant alloy, such as stainless steel.

Residual emissions and steam emanating from the inlet end 216 of the interior 215 of the drum 212 are collected by means shown in the form of an auxiliary hood 360 placed adjacent the inlet end 216. A duct 362 communicates with the hood 360 and provides a passage to an auxiliary stack 364 within which an exhaust fan 366 operates to exhaust the emissions and steam collected in the hood 360. The heated gases exhausted from the tubular members 250 also are passed into the auxiliary stack 364, as seen at 368, to be exhausted to the atmosphere. Alternately, should the residual emissions contain excessive pollutants, duct 362 may be routed to plenum 340, instead of to auxiliary stack 364.

In order to enhance the portability and versatility of the apparatus 200, as well as enable ready access to the interior 242 of the heating chamber 230 for cleaning and maintenance, the burner 240 and the volatile organic compound oxidation device 320 are selectively detached from the heating chamber 230 by coupling means which enable the selective translation of the burner 240 and the volatile organic compound oxidizing device 320 into and out of coupled engagement with the heating chamber 230. Thus, the burner 240 is mounted upon a wheeled carriage 370 which, in turn, is placed upon tracks 372 extending longitudinally essentially parallel to the central axis CC of the drum 212. Likewise, the volatile organic compound oxidizing device 320 is mounted on a wheeled carriage 374 which, in turn, is placed upon the tracks 372. The burner 240 and the device 320 are selectively translated along the tracks 372 in the direction 380 away from the drum 212 in order to retract and uncouple the burner 240 and the device 320 from the heating chamber 230 to expose the interior 242 of the heating chamber 230. The burner 240 and the device 320 are advanced, by translation along the tracks 372 in the direction 382, so as to telescopically engage the volatile organic compound oxidation device 320 and the heating chamber 230 to couple the burner 240 and the device 320 with the heating chamber 230 for operation of the apparatus 200. The tracks 372 are supported on a frame 384 of a smaller trailer 386 having a carriage 388 for transport independent of the truck trailer 390 upon which the drum 212 is carried. A winch 392 is mounted upon the frame 384 of the trailer 386 and is coupled with the tracks 372 by means of cables 396 in order to enable selective upward and downward movement of the forward ends of the tracks 372 so as to align the tracks 372 generally parallel with the central axis CC of the drum 212 and place the burner 240 and the device 320 in appropriate alignment for coupling with the heating chamber 230. Dynamic seals 398 are provided between those component parts which rotate with the rotation of the drum 212 and those component parts which remain stationary.

Figure 7:
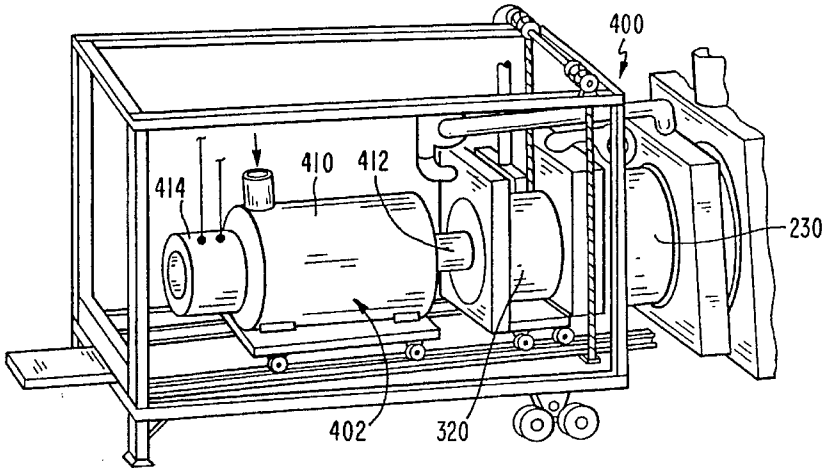
FIG. 7 is a fragmentary pictorial view showing still another embodiment of the invention.

In the embodiment of FIG. 7, another apparatus 400 is shown, which is similar in construction and operation to apparatus 200, except that the burner 240 has been replaced by another heating means 402 for providing a source of heat for the volatile organic compound oxidation device 320 and the heating chamber 230. In this instance, the heating means is a heat-cycle operated engine shown in the form of a gas turbine 410, and the exhaust of the gas turbine 410 is coupled at 412 to the volatile organic compound oxidation device 320 to provide the heat necessary to operate apparatus 400. The gas turbine 410 is coupled to a generator 414 for generating electrical power, some of which is used to operate the electric motors 226 which rotate the drum 212. Electric power from generator 414 also is made available for other power requirements at the site of the apparatus. Thus, apparatus 400 not only is self-contained for use at a variety of sites, but provides electrical power at the site.

Figure 8:
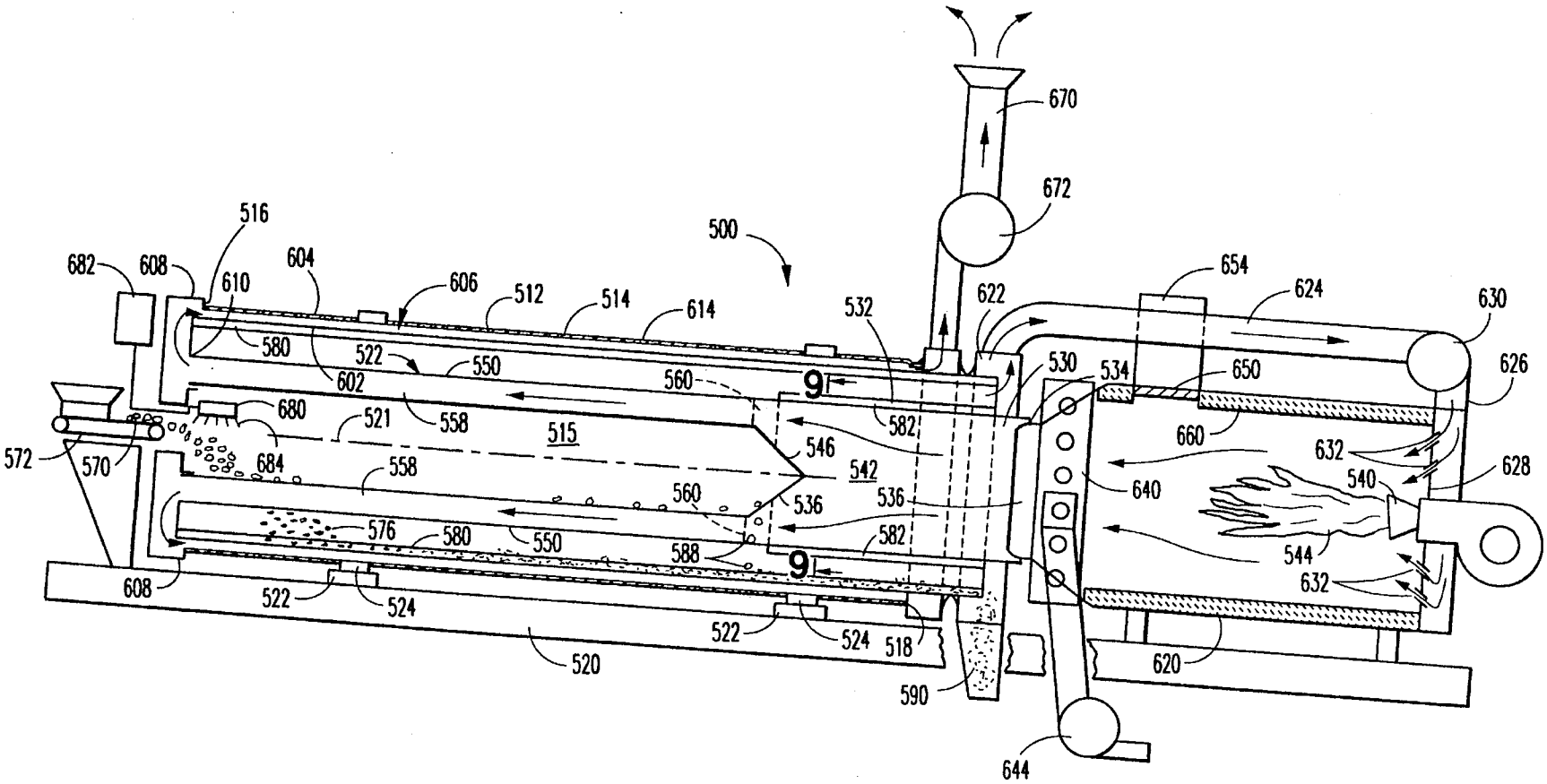
FIG. 8 is a diagrammatic, longitudinal cross-sectional view of another apparatus constructed in accordance with the present invention illustrating another embodiment of the invention.

Referring now to FIG. 8, another embodiment of the invention is illustrated in the form of apparatus 500 which is seen to include an elongate drum 512 having a generally cylindrical wall 514 and an interior 515 extending axially between an inlet end 516 and an outlet end 518. Drum 512 is mounted upon a platform 520 for rotation about a central axis 521 by means of roller assemblies 522 placed on the platform 520 and engaging corresponding circumferential tracks 524 carried by the drum 512, all in a manner similar to that described above in connection with apparatus 10. The drum 512 is inclined so that the inlet end 516 is elevated relative to the outlet end 518. The angle of inclination is maintained relatively shallow and is adjustable, all as described above in connection with apparatus 10.

Heating means is shown in the form of a heating chamber 530 located adjacent the outlet end 518 of the interior 515 of the drum 512 and including a cylindrical side wall 532 which extends along the drum 512 toward the inlet end 516 over a first axial portion of drum 512 from an inlet end 534 of the heating chamber 530 to a front wall 536. A burner 540 is located outside the heating chamber 530 and projects toward the interior 542 of the heating chamber 530 to provide a heating flame 544 projecting toward the interior 542 of the heating chamber 530. A baffle 546 is provided at the front wall 536.

A plurality of breaker members in the form of tubular members 550 extend axially, along a second axial portion of drum 512, between the heating chamber 530 and the inlet end 516 of the interior 515 of the drum 512, generally parallel to the central axis 521, and are arrayed circumferentially about the central axis 521. The tubular members 550 are assembled into a cage-like assembly 552 which is supported within the drum 512 in a manner similar to that described in connection with tubular members 50 above, each tubular member 550 having an interior 558 which extends axially along the length of the tubular member 550. Headers in the form of manifolds 560 are integral with the ends of the tubular members 550 adjacent the heating chamber 530, and the manifolds 560 are integral with the front wall 536 of the heating chamber 530 to connect the tubular members 550 with the heating chamber 530. The interior 558 of each tubular member 550 communicates with the interior 542 of the heating chamber 530 through each corresponding manifold 560 so that hot gases in the heating chamber 530 pass through the manifolds 560 and into the tubular members 550.

Recyclable asphalt material is received from the field in relatively large pieces 570 fed by an infeed conveyor 572 through the inlet end 516 of the interior 515 of drum 512 and into the cage-like assembly 552 established by the array of tubular members 550. As the drum 512 is rotated, the cage-like assembly 552 also rotates about the central axis 521 and the large pieces 570 are tumbled within the cage-like assembly 552 and simultaneously are broken up and heated by contact with the tubular members 550 of the cage-like assembly 552 as the recyclable asphalt material gravitates downstream from the inlet end 516 toward the outlet end 518 of the interior 515 of drum 512. The circumferential spacing between adjacent tubular members 550 is selected so that upon reaching the desired aggregate-size, the recyclable asphalt material 576 will drop out of the cage-like assembly 552, and fall to wall 514 of the drum 512, all as described above in connection with apparatus 10. The desired aggregate-sized recyclable asphalt material 576 continues down the wall 514 of the drum 512, assisted by flights 580 affixed to the wall 514, until the material 576 reaches the outlet end 518 of the interior 515 of the drum 512. In addition, material 576 is tumbled onto the side wall 532 of the heating chamber 530 where additional heat is transferred to the material 576 and further flights 582 affixed to side wall 532 assist in moving the material 576 downstream.

As before, intermediate-sized pieces 588 of recyclable asphalt material which now are smaller than pieces 570, but still remain larger than that which is permitted to fall through the spacing between the tubular members 550, will fall at manifolds 560 to enter the mass of material in the stream 590 of asphalt material leaving the drum 512. The stream 590 of desired aggregate-sized pieces of material 576 is delivered through an exit chute to an outfeed conveyor, as described before.

In the preferred configuration, wall 514 of drum 512 is comprised of an inner wall 602 and an outer wall 604, with a heat conduit in the form of an annular heat passage 606 between the inner wall 602 and the outer wall 604. Duct means are provided in the form of return members 608 connected between the end 610 of each tubular member 550 and the annular heat passage 606 so that the heated gases which pass from the heating chamber 530 through the tubular members 550 are directed into the annular heat passage 606 to flow through the wall 514 of the drum 512 and further heat the wall 514 as the heated gases are passed downstream. In this manner heat is conserved and more heat is made available for the process. An insulating jacket 614 extends circumferentially around the drum 512 to further conserve heat, as explained in U.S. Pat. No. 4,932,863.

Volatile pollutants which emanate from the recyclable asphalt material as the process is being carried out in the apparatus 500 are dealt with by oxidizing the pollutants in a volatile organic compound oxidation device 620. To that end, the volatile pollutants are conducted from the interior 515 of the drum 512 to the volatile organic compound oxidation device 620 by gas conduction means shown in the form of a manifold 622 located adjacent the outlet end 518 of the interior 515 of the drum 512 and a duct 624 extending between and communicating with the manifold 622, and a plenum chamber 626 extending around the outer periphery of the volatile organic compound oxidation device 620 at the inlet end 628 of the volatile organic compound oxidation device 620. A fan 630 draws the volatile pollutants from the interior 515 of the drum 512, through the manifold 622 and duct 624, and forces the volatile pollutants into the plenum chamber 626, to pass through openings 632 into the volatile organic compound oxidation device 620, all in a manner similar to that described above in connection with apparatus 200.

The volatile organic compound oxidation device 620 is interposed between the burner 540 and the heating chamber 530 for operation as described above. As before, cooling means are interposed between the volatile organic compound oxidation device 620 and the heating chamber 530 to reduce selectively the temperature between the outlet 636 of the volatile organic compound oxidation device 620 and the interior 542 of the heating chamber 530 and include a plenum 640 and a blower 644 which forces ambient air into the plenum 640 for distributing ambient air to the interior of the heating chamber 530 to reduce the temperature at the inlet end 534 of the heating chamber 530.

When use of the apparatus 500 is to be discontinued, there is a gradual slow-down in production in the drum 512, requiring lowered heat to the tubular members 550; however, full heat must be maintained in the volatile organic compound oxidation device 620 for continued appropriate operation during the transition from full operation to full shut-down. Accordingly, heat is bypassed by the opening of a damper 650 located adjacent the outlet 636 of the volatile organic compound oxidation device 620, which damper 650 is opened to vent excess heat through a by-pass exhaust 654 in order to bypass heat from the volatile organic compound oxidation device 620 away from the heating chamber 530 and thereby protect the component parts of the apparatus 500 against excessively high temperatures during cool down. As a further measure of protection against the effects of excessive heat, it is preferable to construct the heating chamber 530, the manifolds 560 and at least the portions of the tubular members 550 located adjacent the manifolds 560 and the heating chamber 530, of a heat and corrosion resistant alloy, such as stainless steel. A liner 660 of refractory material further protects against excessive heat.

The annular heat passage 606, between the inner wall 602 and the outer wall 604 of the drum 512, extends along the drum 512 between the inlet end 516 and the outlet end 518 and is coaxial with the tubular members 550. The heat passage 606 and the interior 588 of the tubular members 550 are connected together serially by the return members 608 such that the heated gases from the interior 542 of the heating chamber 530 are conducted from adjacent the outlet end 518 of the drum 512 to adjacent the inlet end 516 and are returned to adjacent the outlet end 518 serially through the tubular members 550 and the heat passage 606, to be exhausted at an exhaust stack 670, with the aid of an exhaust fan 672. The serial arrangement of the coaxial tubular members 550 and heat passage 606 establishes a heating circuit which enables effective and efficient use of the heat produced by the heating means without exposure of the asphalt material to the hot gases emanating from the heating chamber 530.

A spray head 680 is placed within the drum 512, adjacent the inlet end 516, and is connected to a supply 682 of rejuvenating agent or of virgin asphalt for the selective addition of a rejuvenating agent or virgin asphalt. The spray 684 from spray head 680 also serves as a screen tending to reduce dust which otherwise could emanate from the inlet end 516.

Figure 9:
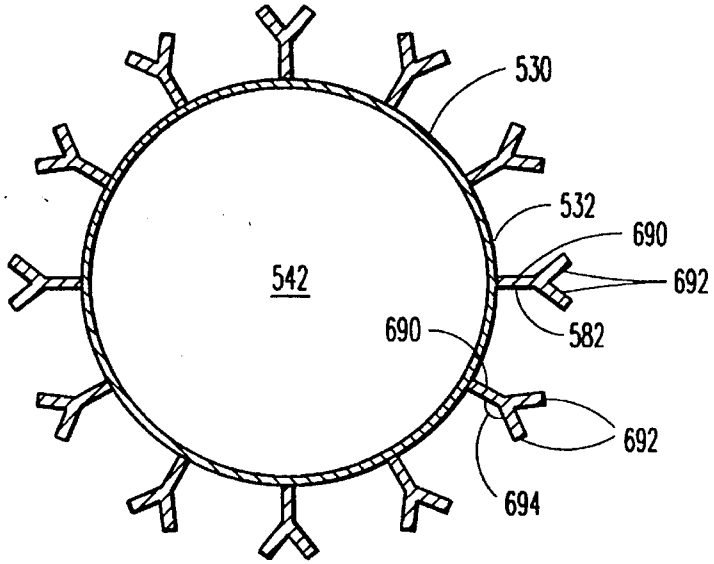
FIG. 9 is an enlarged fragmentary cross-sectional view taken along line 9—9 of FIG. 8.

The effectiveness of the transfer of heat from the heating chamber 530 through the side wall 532 of the heating chamber 530 to the asphalt material moving along the side wall 532 of the heating chamber 530 is enhanced by the particular shape of the flights 582 affixed to the side wall 532 of the heating chamber 530 and contacting the asphalt material. Thus, as best seen in FIG. 9, the flights 582 each have a Y-shaped cross-sectional configuration, including a central stem 690 projecting from the side wall 532 and branches 692 each diverging from the stem 690 at an obtuse angle 694 to the stem 690. The flow of asphalt material in the radial direction is retarded by the branches 692 to enable heat to be transferred to the asphalt material, through the side wall 532 and the flights 582, without unduly impeding the progress of the asphalt material as the asphalt material drops from the flights 582 and gravitates toward outlet end 518, and without fostering an accumulation of asphalt material on the flights 582.

Figure 10:
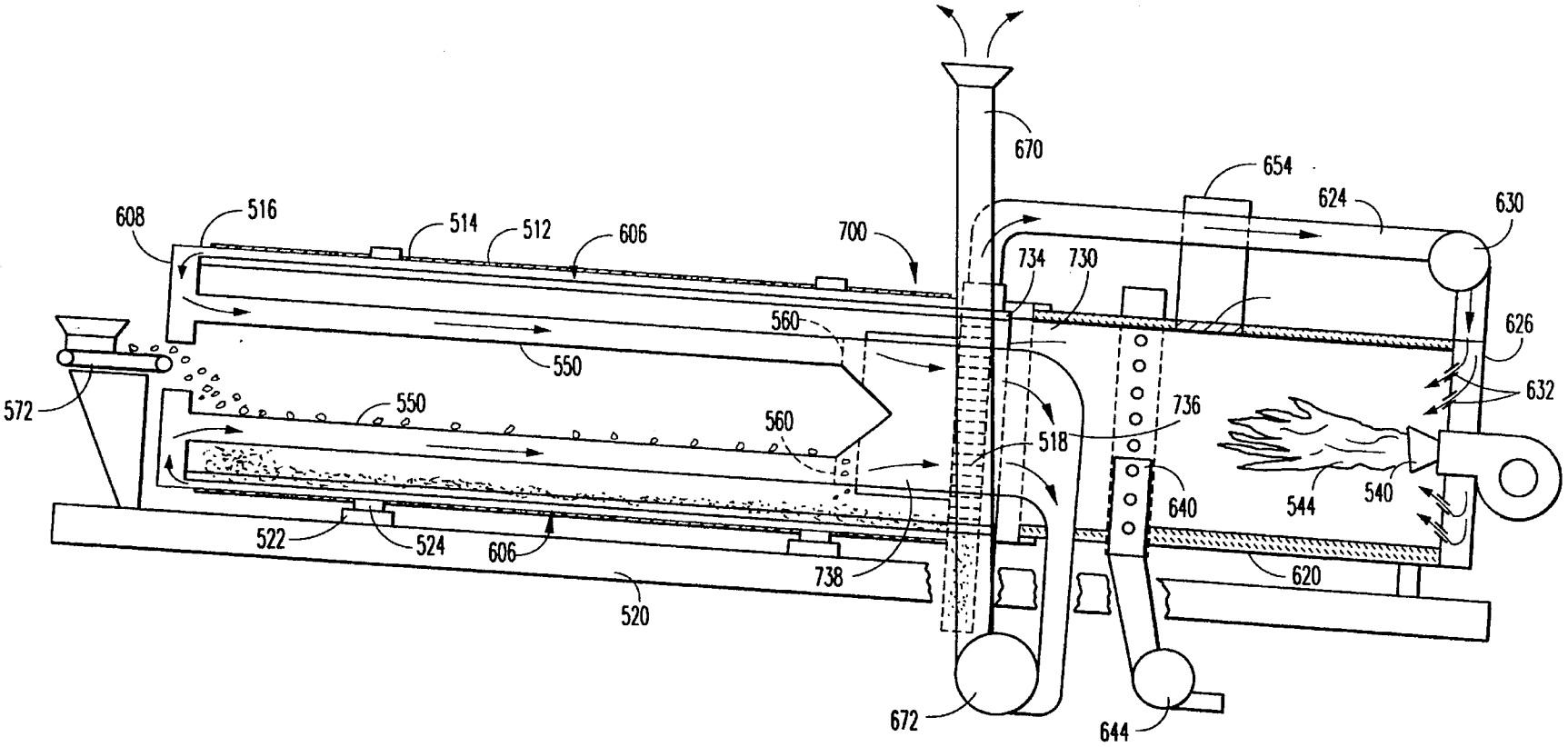
FIG. 10 is a diagrammatic, longitudinal cross-sectional view of another apparatus constructed in accordance with the present invention illustrating still another embodiment of the invention.

The embodiment of the invention illustrated as apparatus 700 in FIG. 10 is somewhat similar to the embodiment described above in connection with apparatus 500 of FIGS. 8 and 9 and, to the extent that similar component parts function in a similar manner, the component parts bear the same reference characters as those employed in connection with the corresponding component parts of apparatus 500. However, in apparatus 700 the circulation of heat from the heating chamber 730 through the tubular members 550 and through the annular heat passage 606 is by the flow of heated gases serially from the heating chamber 730 to the annular heat passage 606 and thence through the tubular members 550 to be exhausted to the stack 670, assisted by exhaust fan 672. Thus, the heat circuit in apparatus 700 operates in a direction opposite to that of the heat circuit in apparatus 500. To this end, an inlet baffle 732 directs heated gases from the heating chamber 730 through an annular outlet 734 to the heat passage 606, and an outlet duct 736 is in position to communicate with the manifolds 560, through a return chamber 738 with which the manifolds 560 are connected for communication between the tubular members 550 and the return chamber 738.

Figure 11:
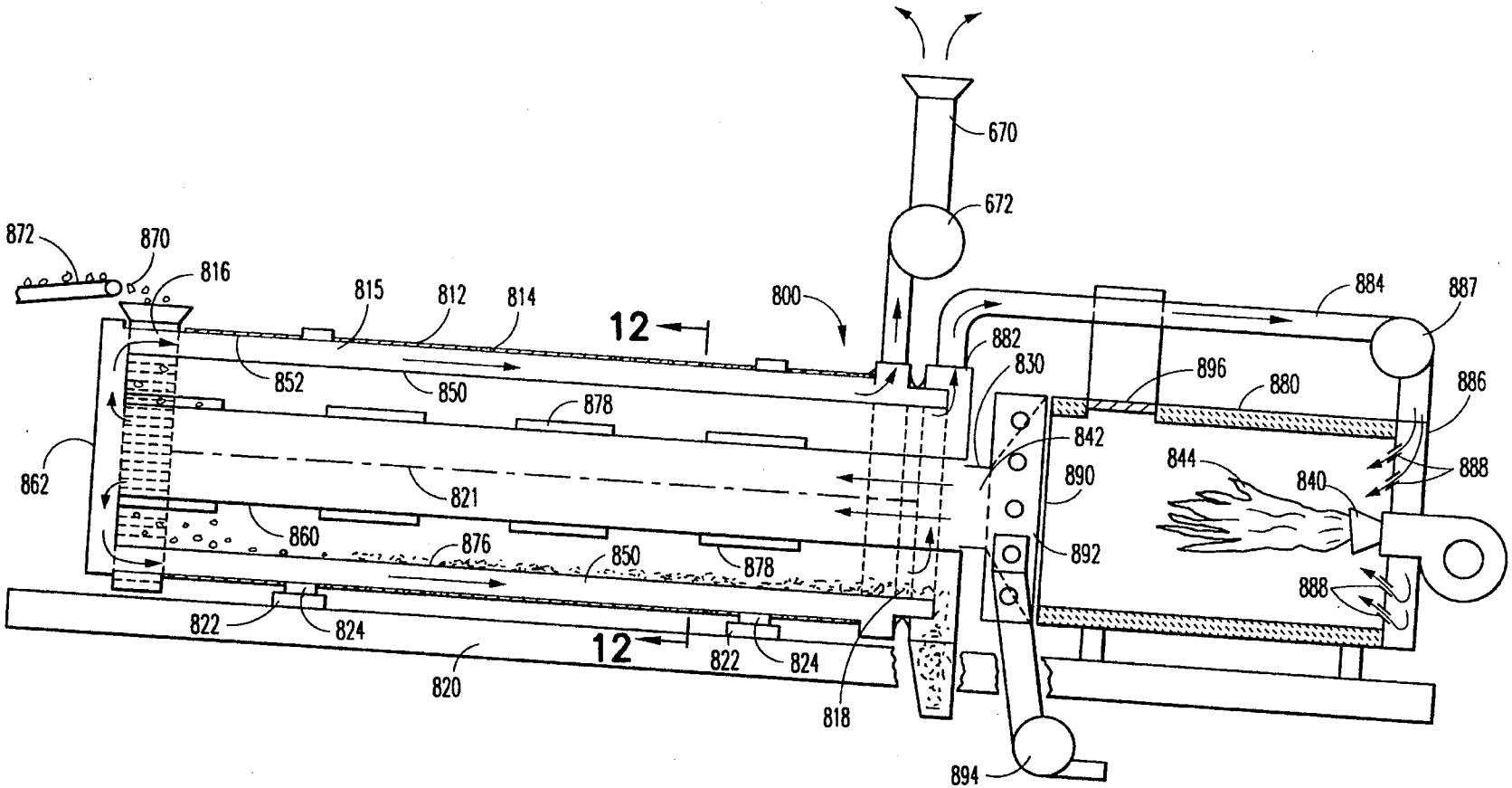
FIG. 11 is a diagrammatic, longitudinal cross-sectional view of another apparatus constructed in accordance with the present invention illustrating yet another embodiment of the invention.

Referring now to FIG. 11, another embodiment of the invention is illustrated in the form of apparatus 800 which is seen to include an elongate drum 812 having a generally cylindrical wall 814 and an interior 815 extending axially between an inlet end 816 and an outlet end 818. Drum 812 is mounted upon a platform 820 for rotation about a central axis 821 by means of roller assemblies 822 placed on the platform 820 and engaging corresponding circumferential tracks 824 carried by the drum 812, all in a manner similar to that described above in connection with apparatus 10. The drum 812 is inclined so that the inlet end 816 is elevated relative to the outlet end 818. The angle of inclination is maintained relatively shallow and is adjustable, all as described above in connection with apparatus 10.

Figure 12:
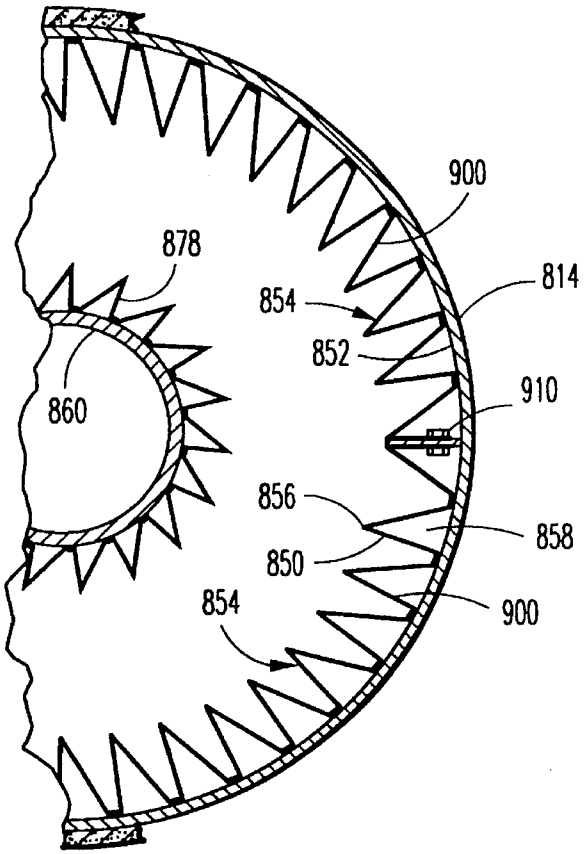
FIG. 12 is a diagrammatic enlarged fragmentary cross-sectional view taken along line 12—12 of FIG. 11.

Heating means is shown in the form of a heating chamber 830 located adjacent the outlet end 818 the drum 812. A burner 840 is located outside the heating chamber 830 and projects toward the interior 842 of the heating chamber 830 to provide a heating flame 844 projecting toward the interior 842 of the heating chamber 830. A plurality of breaker members in the form of tubular members 850 extend axially along drum 812, between the heating chamber 830 and the inlet end 816 of the interior 815 of the drum 812, generally parallel to the central axis 821, and are arrayed circumferentially about the central axis 821. In this instance, the tubular members 850 are placed around the inside surface 852 of the drum wall 814 and, as best seen in FIG. 12, are each a part of a sheet-like member 854 which extends circumferentially about the inside surface 852 of the drum wall 814. Each tubular member 850 has a generally V-shaped cross-sectional configuration, which includes an apex 856 oriented so that the apex 856 is located radially closest to the central axis 821 of the drum 812, and an interior 858 which extends axially along the length of the tubular member 850. The particular V-shaped cross-sectional configuration of tubular members 850 provides a greater area for the transfer of heat to the asphalt material while, at the same time, enhancing the lifting and movement of the asphalt material along the interior 815 of the drum 812. A heat conduit in the form of a supply heat tube 860 communicates serially with the tubular members 850 through ducting means provided by an end manifold 862 placed between the supply heat tube 860 and the tubular members 850 adjacent the inlet end 816 of the drum 812 and communicates with the heating chamber 842 adjacent the outlet end 818 of the drum 812. Thus, the heat circuit extends serially from the heating chamber 842, through the supply heat tube 860 to the tubular members 850, and thence to the exhaust stack 670, through exhaust fan 672.

Recyclable asphalt material is received from the field in relatively large pieces 870 and is fed by an infeed conveyor 872 through the inlet end 816 of the interior 815 of drum 812. As the drum 812 is rotated, the large pieces 870 are tumbled and simultaneously are broken up and heated by contact with the tubular members 850 as the recyclable asphalt material gravitates downstream from the inlet end 816 toward the outlet end 818 of the interior 815 of drum 812. As the recyclable asphalt material 876 continues down the length of the drum 812, the material 876 is tumbled onto the exterior of the supply heat tube 860 where additional heat is transferred to the material 876, and flights 878 affixed to the exterior of supply heat tube 860 assist in moving the material 876 downstream.

Volatile pollutants which emanate from the recyclable asphalt material as the process is being carried out in the apparatus 800 are dealt with by oxidizing the pollutants in a volatile organic compound oxidation device 880. To that end, the volatile pollutants are conducted from the interior 815 of the drum 812 to the volatile organic compound oxidation device 880 by gas conduction means shown in the form of a manifold 882 located adjacent the outlet end 818 of the interior 815 of the drum 812 and a duct 884 extending between and communicating with the manifold 882 and a plenum chamber 886. A fan 887 draws the volatile pollutants through the manifold 882 and duct 884, and forces the volatile pollutants into the plenum chamber 886, to pass through openings 888 into the volatile organic compound oxidation device 880, all in a manner similar to that described above in connection with apparatus 200.

The volatile organic compound oxidation device 880 is interposed between the burner 840 and the heating chamber 830 for operation as described above. As before, cooling means are interposed between the volatile organic compound oxidation device 880 and the heating chamber 830 to reduce selectively the temperature between the outlet 890 of the volatile organic compound oxidation device 880 and the interior 842 of the heating chamber 830 and include a plenum 892 and a blower 894 which forces ambient air into the plenum 892 for distributing ambient air to the interior of the heating chamber 830 to reduce the temperature at the inlet end 834 of the heating chamber 830. When use of the apparatus 800 is to be discontinued, heat is bypassed by the opening of a damper 896, as described above.

The employment of sheet-like members 854 enables ready replacement of the tubular members 850 as necessary during the life of apparatus 800. Since it is the tubular members 850 which are exposed to the most severe heat and wear conditions during operation of the apparatus 800, the apparatus is made more economical by enabling ready replacement of the tubular members 850, as necessary. To this end, the sheet-like members 854 are in the form of segments 900 fastened in place by selectively removable fasteners, shown in the form of bolts 910. When the tubular members 850 become worn and require replacement, bolts 910 are unfastened to release segments 900 of the sheet-like members 854 for removal and replacement.

Figure 13:
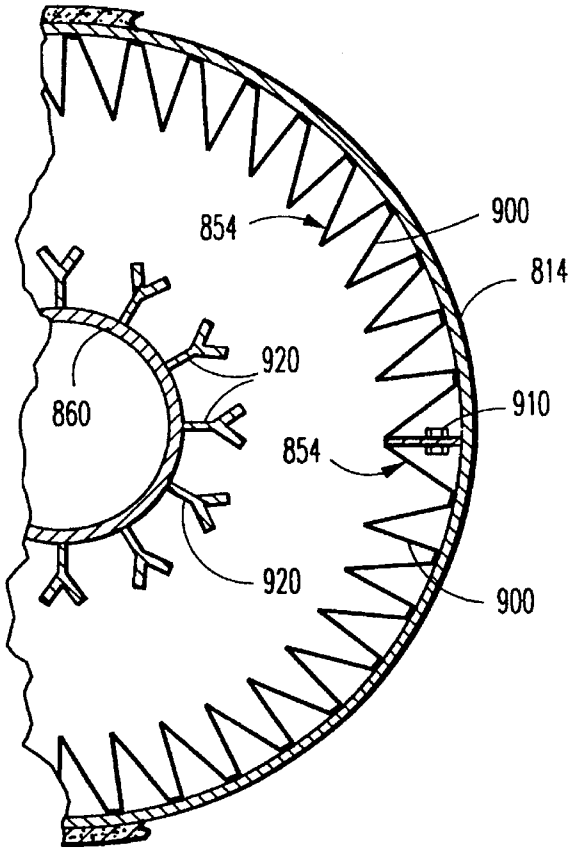
FIG. 13 is a diagrammatic enlarged fragmentary cross-sectional view similar to FIG. 12, but showing another embodiment of the invention.

As depicted in FIG. 12, the flights 878 on the supply heat tube 860 have a cross-sectional configuration similar to that of the tubular members 850, thereby providing some supplemental breaking function to assist in breaking down the larger pieces of asphalt material gravitating along the supply heat tube 860, as well as enhancing the transfer of heat to the asphalt material, and the lifting and movement of the asphalt material along the interior 815 of the drum 812. However, as best seen in FIG. 13, an alternate construction provides alternate flights 920 having a Y-shaped cross-sectional configuration for effective transfer of heat to the asphalt material, as described above in connection with flights 582.

Figure 14:
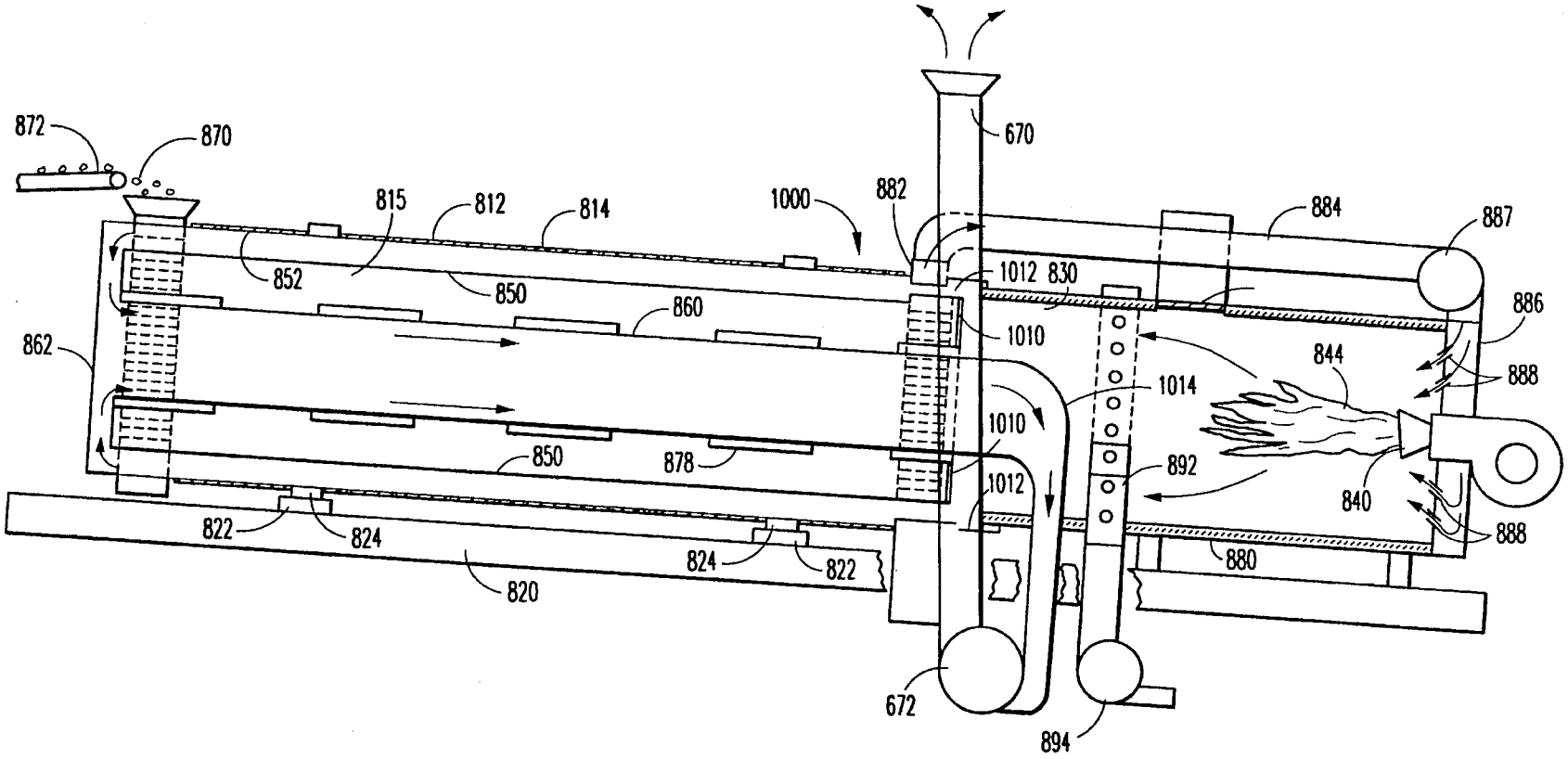
FIG. 14 is a diagrammatic, longitudinal cross-sectional view of another apparatus constructed in accordance with the present invention illustrating a further embodiment of the invention.

The embodiment of the invention illustrated as apparatus 1000 in FIG. 14 is somewhat similar to the embodiment described above in connection with apparatus 800 of FIGS. 11 and 12 and, to the extent that similar component parts function in a similar manner, the component parts bear the same reference characters as those employed in connection with the corresponding component parts of apparatus 800. However, in apparatus 1000 the circulation of heat from the heating chamber 830 through the tubular members 850 and through the heat tube 860 is by the flow of heated gases serially from the heating chamber 830 to the tubular members 850 and thence through the heat tube 860 to be exhausted to the exhaust stack 670, assisted by exhaust fan 672. Thus, the heat circuit in apparatus 1000 operates in a direction opposite to that of the heat circuit in apparatus 800. To this end, an inlet baffle 1010 directs heated gases from the heating chamber 830 through an annular outlet 1012 to the tubular members 850, and an outlet duct 1014 is in position to communicate with the heat tube 860 to exhaust heat to the exhaust stack 670, through exhaust fan 672.

Figure 15:
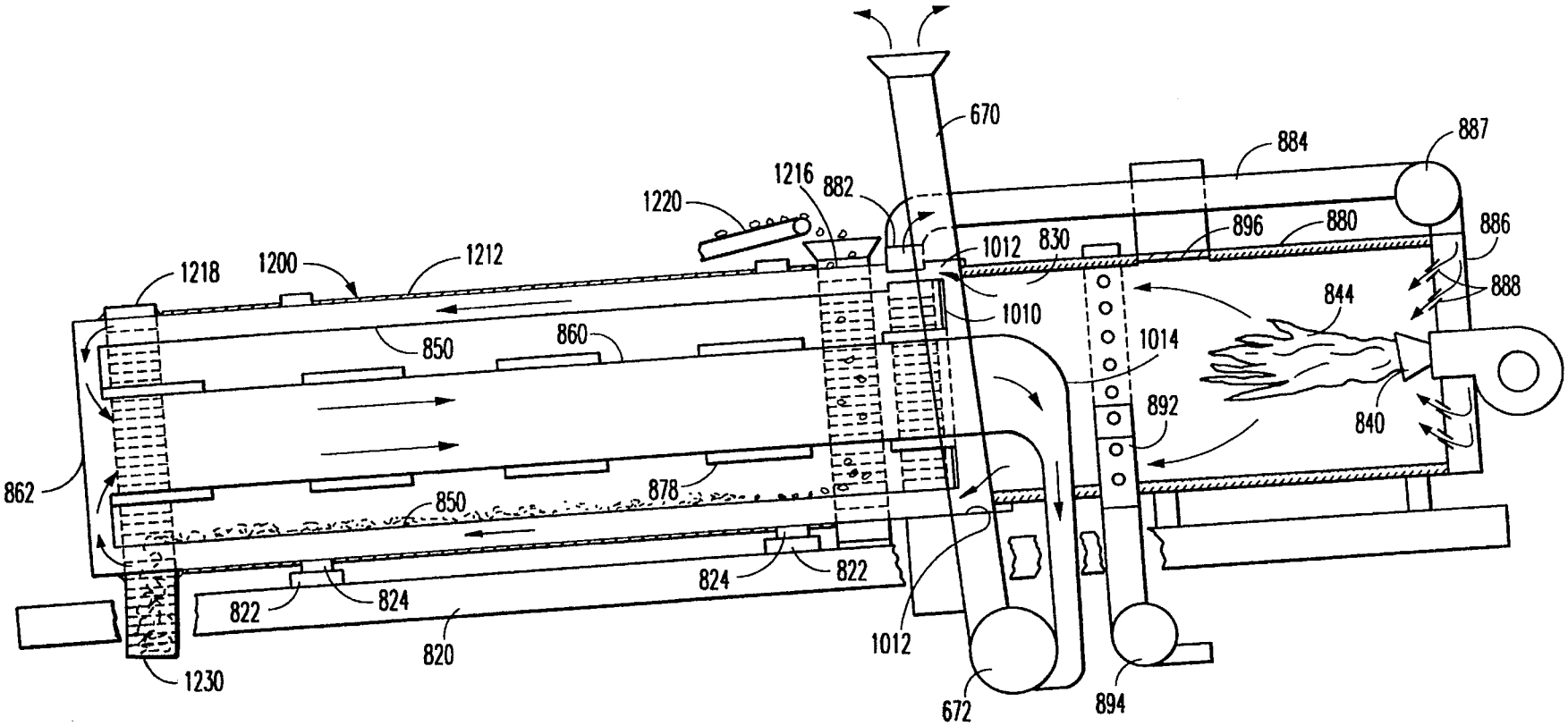
FIG. 15 is a diagrammatic, longitudinal cross-sectional view of another apparatus constructed in accordance with the present invention illustrating a still further embodiment of the invention.

The embodiment of the invention illustrated as apparatus 1200 in FIG. 15 is somewhat similar to the embodiment described above in connection with apparatus 1000 of FIG. 14 and, to the extent that similar component parts function in a similar manner, the component parts bear the same reference characters as those employed in connection with the corresponding component parts of apparatus 1000. However, in apparatus 1200, the inclination of the drum 1212 is in a direction opposite to that of apparatus 800, so that the inlet and outlet ends of the drum are reversed. Thus, in apparatus 1200, the inlet end 1216 is adjacent the heating means, while the outlet end 1218 is adjacent the end of the drum 1212 opposite the heating means. Recyclable asphalt material is received from the field and is fed into apparatus 1200 by an infeed conveyor 1220 through the inlet end 1216 of the drum 1212. The asphalt material gravitates from the inlet end 1216 to the outlet end 1218 where the processed material is discharged for delivery at 1230.

Figure 16:
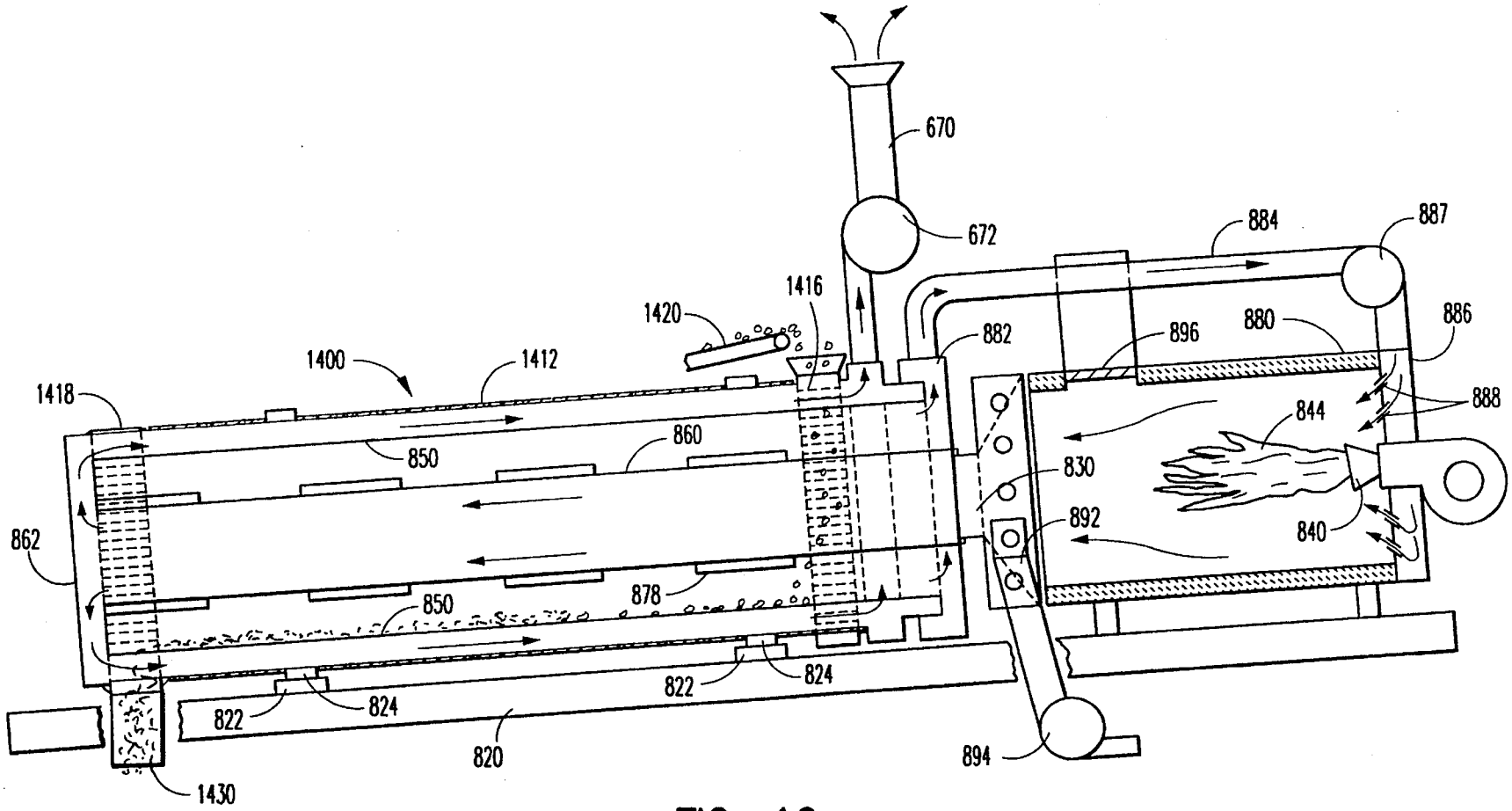
FIG. 16 is a diagrammatic, longitudinal cross-sectional view of another apparatus constructed in accordance with the present invention illustrating yet a further embodiment of the invention.

The embodiment of the invention illustrated as apparatus 1400 in FIG. 16 is somewhat similar to the embodiment described above in connection with apparatus 800 of FIG. 11 and, to the extent that similar component parts function in a similar manner, the component parts bear the same reference characters as those employed in connection with the corresponding component parts of apparatus 800. However, in apparatus 1400, the inclination of the drum 1412 is in a direction opposite to that of apparatus 800, so that the inlet and outlet ends of the drum are reversed. Thus, in apparatus 1400, the inlet end 1416 is adjacent the heating means, while the outlet end 1418 is adjacent the end of the drum 1412 opposite the heating means. Recyclable asphalt material is received from the field and is fed into apparatus 1400 by an infeed conveyor 1420 through the inlet end 1416 of the drum 1412. The asphalt material gravitates from the inlet end 1416 to the outlet end 1418 where the processed material is discharged for delivery at 1430.

Figure 18:
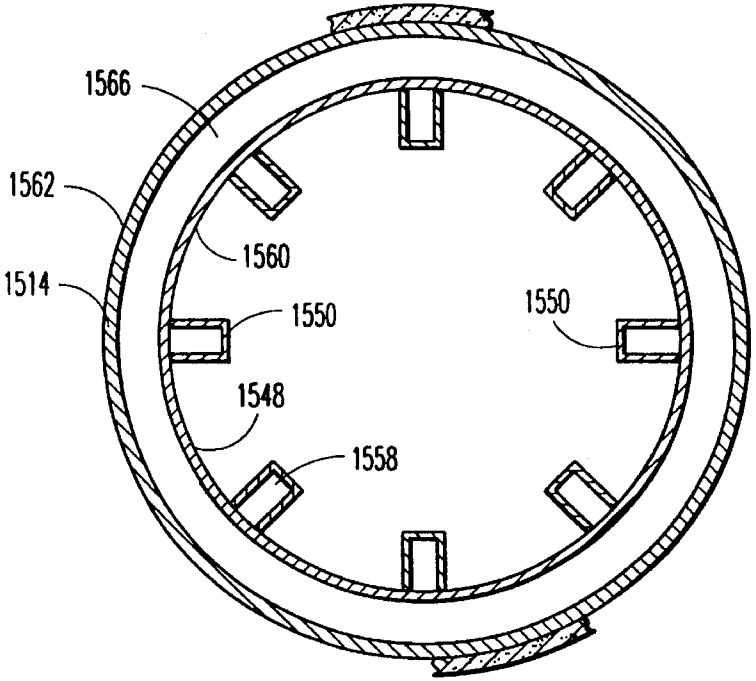
FIG. 18 is a diagrammatic enlarged fragmentary cross-sectional view taken along line 18—18 of FIG. 17.
Figure 17:
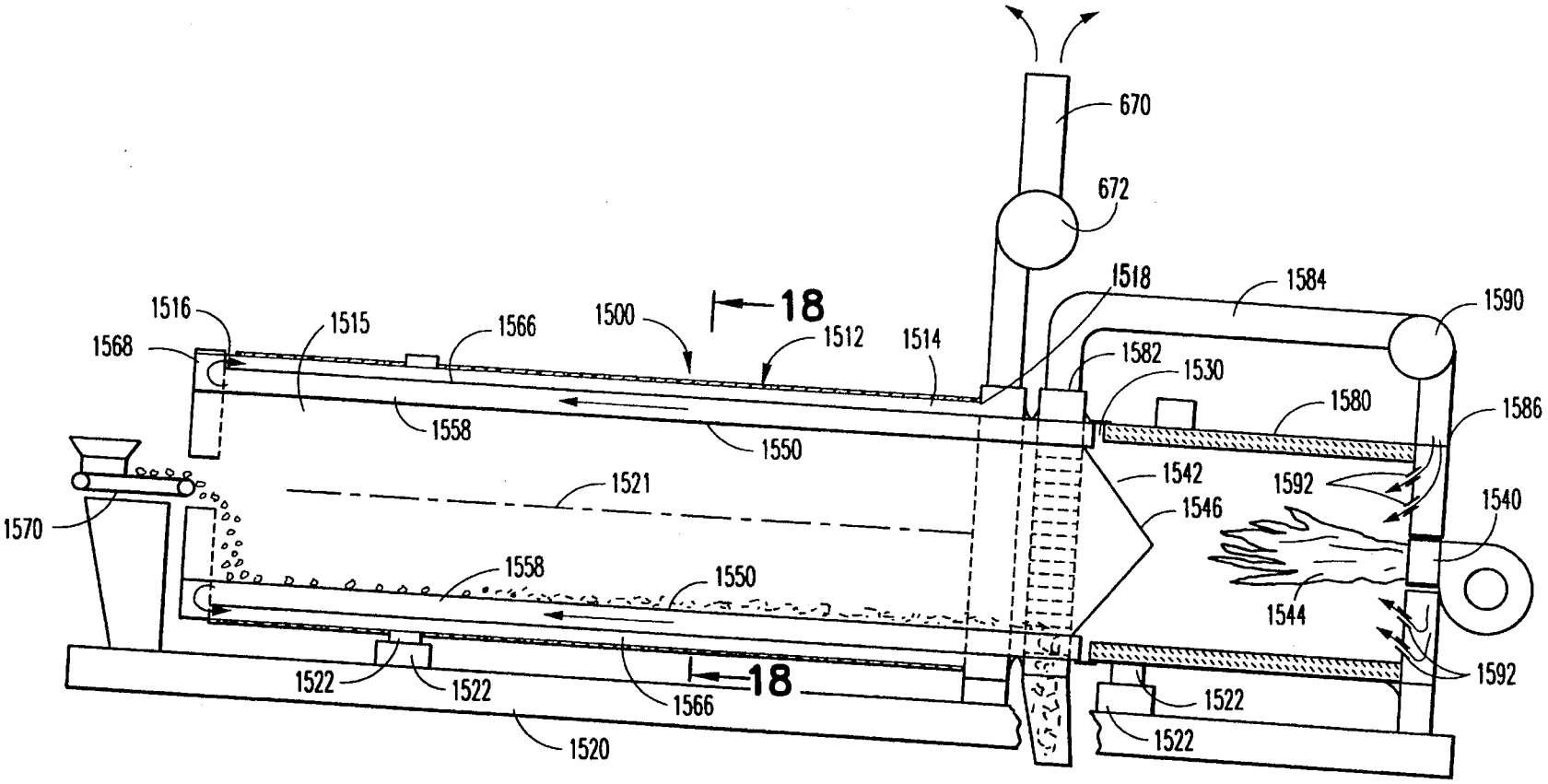
FIG. 17 is a diagrammatic, longitudinal cross-sectional view of another apparatus constructed in accordance with the present invention illustrating another embodiment of the invention.

In the embodiment illustrated in FIGS. 17 and 18, apparatus 1500 is seen to include an elongate drum 1512 having a generally cylindrical wall 1514 and an interior 1515 extending axially between an inlet end 1516 and an outlet end 1518. Drum 1512 is mounted upon a platform 1520 for rotation about a central axis 1521 by means of roller assemblies 1522 placed on the platform 1520 and engaging corresponding circumferential tracks 1524 carried by the drum 1512, all in a manner similar to that described above in connection with apparatus 10. The drum 1512 is inclined so that the inlet end 1516 is elevated relative to the outlet end 1518. The angle of inclination is maintained relatively shallow and is adjustable, all as described above in connection with apparatus 10.

Heating means include a heating chamber 1530 located adjacent the outlet end 1518 of the interior 1515 of the drum 1512. A burner 1540 is located outside the heating chamber 1530 and projects toward the interior 1542 of the heating chamber 1530 to provide a heating flame 1544 projecting toward the interior 1542 of the heating chamber 1530. A baffle 1546 is provided at the front of the heating chamber 1530. A plurality of breaker members in the form of tubular members 1550 extend axially along drum 1512, between the heating chamber 1530 and the inlet end 1516 of the interior 1515 of the drum 1512, generally parallel to the central axis 1521, and are arrayed circumferentially about the central axis 1521. The tubular members 1550 are placed around the inside surface 1548 of the drum wall 1514, as seen in FIG. 18. Each tubular member 1550 has a generally rectangular cross-sectional configuration and includes an interior 1558 which extends axially along the length of the tubular member 1550.

Wall 1514 of drum 1512 is comprised of an inner wall 1560 and an outer wall 1562, with a heat conduit in the form of an annular heat passage 1566 between the inner wall 1560 and the outer wall 1562. Duct means are provided in the form of return members 1568 connected between each tubular member 1550 and the annular heat passage 1566 so that the heated gases which pass from the heating chamber 1542 through the tubular members 1550 are directed into the annular heat passage 1566 to flow through the wall 1514 of the drum 1512 and further heat the wall 1514 as the heated gases are passed downstream. In this manner heat is conserved and more heat is made available for the process. The heat circuit extends serially from the heating chamber 1542 through the tubular members 1550, and then through the annular heat passage 1566 to be exhausted at exhaust stack 670, through exhaust fan 672.

Recyclable asphalt material is received from the field in relatively large pieces and is fed by an infeed conveyor 1570 through the inlet end 1516 of the interior 1515 of drum 1514. As the drum 1512 is rotated, the large pieces are tumbled and simultaneously are broken up and heated by contact with the tubular members 1550 as the recyclable asphalt material gravitates downstream from the inlet end 1516 toward the outlet end 1518 of the interior 1515 of drum 1512. As the recyclable asphalt material continues down the length of the drum 1512, the material is tumbled onto the tubular members 1550 and onto the inner wall 1560 of the drum 1512, which inner wall 1560 is heated by the heated gases passing through the heat passage 1566 between the inner wall 1560 and the outer wall 1562 of the drum 1512. The processed recyclable asphalt material is discharged for delivery at 1572.

Volatile pollutants which emanate from the recyclable asphalt material as the process is being carried out in the apparatus 1500 are dealt with by oxidizing the pollutants in a volatile organic compound oxidation device 1580. To that end, the volatile pollutants are conducted from the interior 1515 of the drum 1512 to the volatile organic compound oxidation device 1580 by gas conduction means shown in the form of a manifold 1582 located adjacent the outlet end 1518 of the interior 1515 of the drum 1512 and a duct 1584 extending between and communicating with the manifold 1582 and a plenum chamber 1586 extending around the outer periphery of the volatile organic compound oxidation device 1580 at the inlet end 1588 of the volatile organic compound oxidation device 1580. A fan 1590 draws the volatile pollutants from the interior 1515 of the drum 1512, through the manifold 1582 and duct 1584, and forces the volatile pollutants into the plenum chamber 1586, to pass through openings 1592 into the volatile organic compound oxidation device 1580, all in a manner similar to that described above in connection with apparatus 1500. The volatile organic compound oxidation device 1580 is interposed between the burner 1540 and the heating chamber 1542 for operation as described above.

Figure 19:
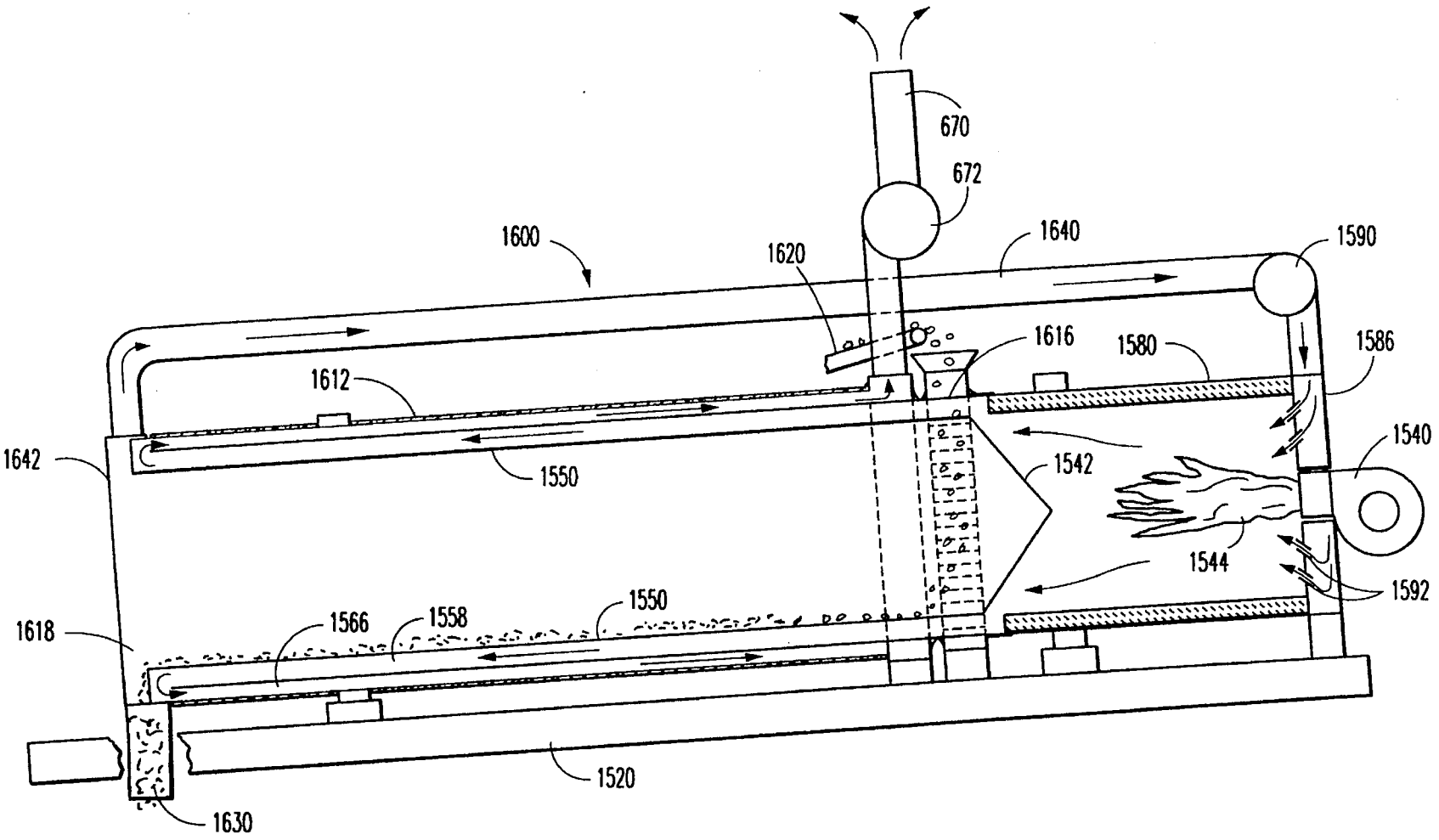
FIG. 19 is a diagrammatic, longitudinal cross-sectional view of another apparatus constructed in accordance with the present invention illustrating still another embodiment of the invention.

The embodiment of the invention illustrated as apparatus 1600 in FIG. 19 is somewhat similar to the embodiment described above in connection with apparatus 1500 of FIGS. 17 and 18 and, to the extent that similar component parts function in a similar manner, the component parts bear the same reference characters as those employed in connection with the corresponding component parts of apparatus 1500. However, in apparatus 1600, the inclination of the drum 1612 is in a direction opposite to that of apparatus 1500, so that the inlet and outlet ends of the drum are reversed. Thus, in apparatus 1600, the inlet end 1616 is adjacent the heating means, while the outlet end 1618 is adjacent the end of the drum 1612 opposite the heating means. Recyclable asphalt material is received from the field and is fed into apparatus 1600 by an infeed conveyor 1620 through the inlet end 1616 of the drum 1612. The asphalt material gravitates from the inlet end 1616 to the outlet end 1618 where the processed material is discharged for delivery at 1630. Volatile pollutants are conducted to the volatile organic compound oxidation device 1580 by a duct 1640 extending between an end hood 1642 and the fan 1590.

It will be seen that the present invention attains the objects and advantages summarized above, namely: Eliminates the need for preliminary crushing and screening of recyclable asphalt materials received from the field, and the equipment needed for such preliminary crushing and screening precludes direct contact between the recyclable asphalt materials and any open flame or hot gases thereby eliminating a potential source of pollutants, and especially "blue-smoke" and hydrocarbon emissions; effectively recycles used asphalt materials for use either in a mix containing a very high percentage of recycled product with virgin aggregate and asphalt or one-hundred percent recycled materials; provides apparatus which is relatively compact and even more portable than before for ready transportation and use directly at a wider variety of project sites; enables increased versatility in complementing existing asphalt plants for the use of recycled asphalt product; provides an environmentally sound approach to the conservation of asphalt products at minimal cost; eliminates the need for disposal of used asphalt materials; effectively deals with pollutants which emanate from the asphalt materials being processed for reuse; enables the practical processing of recyclable asphalt materials for widespread use with efficiency and reliability.

It is to be understood that the above detailed description of preferred embodiments of the invention are provided by way of example only. Various details of design, construction and procedure may be modified without departing from the true spirit and scope of the invention as set forth in the appended claims.

The embodiments of the invention in which an exclusive property or privilege is claimed are defined as follows:

1. Apparatus for processing recyclable asphalt material received from the field in relatively large pieces for delivery in a mass containing desired smaller aggregate-sized pieces for reuse, the apparatus comprising:

an elongate drum having a generally cylindrical wall, a central axis, a first end and a second end, the cylindrical wall including an inner surface and an outer surface;

mounting means for mounting the drum for rotation about the central axis, with the central axis tilted at an acute angle so as to elevate one of the first and second ends relative to the other of the first and second ends;

a heating chamber adjacent the first end of the drum, the heating chamber having an interior;

a plurality of breaker members, the breaker members being tubular and extending along the drum between the first and second ends of the drum, the breaker members being arrayed generally parallel to the central axis of the drum and placed between the central axis and the wall of the drum;

a heat conduit extending along the drum between the first and second ends of the drum, the heat conduit being coaxial with the breaker members;

heating means for supplying heat to the interior of the heating chamber;

ducting means interconnecting the interior of the heating chamber, the breaker members, and the heat conduit serially such that heat from the interior of the heating chamber is conducted from adjacent the first end of the drum to adjacent the second end of the drum and is returned to adjacent the first end of the drum serially through the breaker members and the heat conduit;

feed means for feeding the large pieces of recyclable asphalt material received from the field into the drum, adjacent the elevated one of the first and second ends of the drum; and rotational means for rotating the drum, the breaker members and the heat conduit about the central axis so as to tumble the large pieces of recyclable asphalt material within the drum, against the breaker members and against the heat conduit, thereby simultaneously reducing the size of the relatively large pieces to the desired aggregate-sized pieces and heating the mass containing the desired aggregate-sized pieces, which mass proceeds toward the other of the first and second ends of the drum for delivery from the drum.

2. The invention of claim 1 wherein the interior of the heating chamber communicates with the breaker members adjacent the first end of the drum, the heat conduit communicates with the breaker members adjacent the second end of the drum, and the heat is exhausted from the heat conduit adjacent the first end of the drum.

3. The invention of claim 1 wherein the heating chamber communicates with the heat conduit adjacent the first end of the drum, the breaker members communicate with the heat conduit adjacent the second end of the drum, and the heat is exhausted from the breaker members adjacent the first end of the drum.

4. The invention of claim 1 wherein the first end of the drum is elevated relative to the second end of the drum, the feed means feeds the large pieces of recyclable asphalt material into the drum adjacent the first end of the drum, and the mass containing the desired aggregate-sized pieces is delivered from the drum adjacent the second end of the drum.

5. The invention of claim 1 wherein the second end of the drum is elevated relative to the first end of the drum, the feed means feeds the large pieces of recyclable asphalt material into the drum adjacent the second end of the drum, and the mass containing the desired aggregate-sized pieces is delivered from the drum adjacent the first end of the drum.

6. The invention of claim 1 wherein at least some of the breaker members have a generally V-shaped cross-sectional configuration including an apex, with the V-shaped cross-sectional configuration oriented such that the apex is radially closest to the central axis of the drum.

7. The invention of claim 1 wherein the breaker members lie in a sheet-like member extending circumferentially along at least a portion of the inner surface of the cylindrical wall of the drum, and the apparatus includes selective fastener means for selectively fastening the sheet-like member in place along said portion of the inner surface of the cylindrical wall of the drum and selectively releasing the sheet-like member from said portion of the inner surface of the cylindrical wall of the drum.

8. The invention of claim 7 wherein at least some of the breaker members have a generally V-shaped cross-sectional configuration including an apex, with the V-shaped cross-sectional configuration oriented such that the apex is radially closest to the central axis of the drum.

9. The invention of claim 1 wherein the heat conduit is located between the inner surface and the outer surface of the cylindrical wall of the drum.

10. The invention of claim 1 wherein the heat conduit is located along the central axis of the drum.

11. The invention of claim 1 including flights along the heat conduit for assisting movement of the mass of asphalt material along the drum.

12. The invention of claim 11 wherein the flights have a Y-shaped cross-sectional configuration, the Y-shaped cross-sectional configuration including a stem projecting from the heat conduit, and branches extending from the stem, at an obtuse angle to the stem.

* * * * *